US007375695B2

(12) United States Patent
Ishizuka et al.

(10) Patent No.: US 7,375,695 B2
(45) Date of Patent: May 20, 2008

(54) ANTENNA AND WIRELESS COMMUNICATION DEVICE

(75) Inventors: Kenichi Ishizuka, Sagamihara (JP); Kazunari Kawahata, Machida (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 11/829,653

(22) Filed: Jul. 27, 2007

(65) Prior Publication Data

US 2007/0268191 A1 Nov. 22, 2007

Related U.S. Application Data

(63) Continuation of application No. PCT/JP2005/022342, filed on Dec. 6, 2005.

(30) Foreign Application Priority Data

Jan. 27, 2005 (JP) ..... 2005-020199
Aug. 23, 2005 (JP) ..... 2005-241890

(51) Int. Cl.
*H01Q 9/00* (2006.01)

(52) U.S. Cl. ..... 343/745

(58) Field of Classification Search ..... 343/745, 343/702, 700 MS, 744, 750; 340/572.7, 340/572.8

See application file for complete search history.

(56) References Cited

U.S. PATENT DOCUMENTS 6,492,953 B2 * 12/2002 Apostolos ..... 343/744
6,606,069 B2 8/2003 Kitamura et al.
6,670,925 B2 12/2003 Iwai et al.
6,765,536 B2 * 7/2004 Phillips et al. ..... 343/702
7,034,760 B2 * 4/2006 Nakamura ..... 343/745
7,129,907 B2 * 10/2006 Lin et al. ..... 343/876
7,202,790 B2 * 4/2007 Copeland et al. ..... 340/572.7
2002/0044092 A1 4/2002 Kushihi (Continued)

FOREIGN PATENT DOCUMENTS

JP 2002-076750 A 3/2002

(Continued)

OTHER PUBLICATIONS

Official communication issued in the counterpart International Application No. PCT/JP2005/022342, mailed on Mar. 14, 2006.

*Primary Examiner*—Huedung Mancuso
(74) *Attorney, Agent, or Firm*—Keating & Bennett, LLP

(57) ABSTRACT

An antenna and a wireless communication device are adapted to have a plurality of resonant frequencies changed simultaneously by a desired range at a low voltage. The antenna includes a first antenna section and a second antenna section. The first antenna section includes a feeding electrode, a frequency-changing circuit, and a radiating electrode, and the second antenna section includes the feeding electrode, a first reactance circuit, and an additional radiating electrode. The frequency-changing circuit has a circuit configuration in which the first reactance circuit and the second reactance circuit are connected. When a control voltage Vc is applied to a node P, the reactances of the first and second reactance circuits change in accordance with the magnitude of the control voltage Vc, so that a resonant frequency f1 of the first antenna section and a resonant frequency f2 of the second antenna section change simultaneously.

17 Claims, 18 Drawing Sheets

U.S. PATENT DOCUMENTS

| | | | | |
|---|---|---|---|---|
| 2002/0154063 | A1* | 10/2002 | Klaavo et al. | 343/700 MS |
| 2002/0180558 | A1 | 12/2002 | Iwai et al. | |
| 2003/0003862 | A1 | 1/2003 | Yoshida et al. | |
| 2006/0197711 | A1 | 9/2006 | Sekiguchi et al. | |
| 2007/0091006 | A1* | 4/2007 | Thober et al. | 343/745 |

FOREIGN PATENT DOCUMENTS

| | | | |
|---|---|---|---|
| JP | 2002-158529 | A | 5/2002 |
| JP | 2002-232313 | A | 8/2002 |
| JP | 2003-051712 | A | 2/2003 |
| JP | 2004-320611 | A | 11/2004 |

* cited by examiner

ANTENNA AND WIRELESS COMMUNICATION DEVICE

BACKGROUND OF THE INVENTION

1. Field of the Invention

The present invention relates to antennas used for wireless communications and to wireless communication devices.

2. Description of the Related Art

Recently, in the field of wireless communication devices, such as cellular phones, development for achieving multiple resonances or multiple bands is in progress in order to achieve wide bandwidths. Research studies are being carried out for antennas in which a plurality of resonant frequencies are controlled to allow transmission and reception with a wide bandwidth. Also, antennas in which a frequency can be changed to achieve a wide bandwidth are being considered.

Examples of such antennas that have been proposed include antennas disclosed in Patent Documents 1 to 3.

An antenna disclosed in Patent Document 1 (Japanese Unexamined Patent Application Publication No. 2003-51712), is an inverted-F-shaped antenna device. More specifically, an antenna element is disposed in parallel above a ground conductor, and at least one coupling element is provided in parallel between the ground conductor and the antenna element. The antenna element is electrically connected to the ground conductor via a short-circuiting conductor, and is connected to a feeding point of a feeding coaxial cable. By providing the coupling element in addition to the antenna element as described above, two resonant frequencies are obtained.

In an antenna disclosed in Patent Document 2 (Japanese Unexamined Patent Application Publication No. 2002-232313), an antenna element and a variable capacitor are provided, the variable capacitor being connected in series or parallel with the antenna element to form a resonant circuit, and the control voltage is applied to the variable capacitor to change a resonant frequency.

In an antenna disclosed in Patent Document 3 (Japanese Unexamined Patent Application Publication No. 2004-320611), a radiating element and a tuning circuit are connected in series. In the tuning circuit, a first inductor is connected in series with a parallel circuit including a variable capacitor. A first resonance frequency is obtained by a first antenna element and a second antenna element connected in series, and a second resonant frequency is obtained by the first antenna element alone. Furthermore, a third resonant frequency is obtained by a third antenna element provided from a feeding element.

However, the antennas according to the related art described above have the following problems.

Regarding the antenna disclosed in Patent Document 1, since the antenna is an inverted-F-shaped antenna device, when the antenna is mounted on a small and thin wireless communication device such as a cellular phone, the position of attachment of the coupling element is restricted to a low position because the height from the ground conductor to the antenna element must be small. Thus, restriction is imposed on the control of resonant frequencies of multiple resonances, so that the bandwidth can be increased only to approximately 1.5 times the bandwidth of an inverted-F antenna element. Also, the bandwidth ratio is approximately several percent at best.

Regarding the antenna disclosed in Patent Document 2, it is possible to control the resonant frequency according to the control voltage. However, since a frequency-changing resonance circuit implemented using a variable capacitor is provided in the proximity of a feeding section of the antenna element, the condition of matching between the feeding section and the antenna element changes. Thus, a complex matching circuit is needed. As contrasted with the above, an example where a frequency-changing resonance circuit is provided at a distal-end portion of an antenna element is disclosed. In this example, although a complex circuit configuration is not required, since the resonance circuit is provided at the distal-end portion of the antenna element, where the electric field is most intense (current density is smallest), it is not possible to change the resonant frequency greatly. Furthermore, a large control voltage is needed in order to change the resonant frequency of the antenna by a desired range by controlling a single variable capacitor. This does not allow for satisfaction of the demand for low-voltage operation required for a wireless communication device such as a cellular phone.

Regarding the antenna disclosed in Patent Document 3, it is possible to achieve multiple resonances and to change resonant frequencies. However, since the third antenna element is connected in parallel to the feeding element without an intervening tuning circuit, it is not possible to change the third resonant frequency significantly. Furthermore, since the parallel circuit is disposed in the proximity of a feeding section of the radiating element, the problems of the antenna disclosed in Patent Document 2 also exist.

SUMMARY OF THE INVENTION

In order to overcome the problems described above, preferred embodiments of the present invention provide an antenna and a wireless communication device in which a plurality of resonant frequencies can be changed simultaneously by a desired range at a low voltage.

According to a preferred embodiment of the present invention, an antenna includes a first antenna section in which a radiating electrode having an open distal end is connected to a feeding electrode via a frequency-changing circuit, and a second antenna section including an additional radiating electrode and the feeding electrode, the additional radiating electrode having an open distal end and being connected to a middle portion of the frequency-changing circuit, wherein the frequency-changing circuit is defined by a first reactance circuit and a second reactance circuit connected to each other, the first reactance circuit being connected to the feeding electrode and having a reactance that is variable according to a direct-current control voltage, and the second reactance circuit being connected to the radiating electrode of the first antenna section, and wherein the additional radiating electrode of the second antenna section branches from a node between the first and second reactance circuits.

With the configuration described above, the first antenna section includes the feeding electrode, the frequency-changing circuit, and the radiating electrode, and the second antenna section includes the feeding electrode, the first reactance circuit of the frequency-changing circuit, and the additional radiating electrode. Thus, it is possible to achieve multiple resonances with a resonant frequency associated with the first antenna section and a resonant frequency associated with the second antenna section. By changing the reactance of the first reactance circuit of the frequency-changing circuit, the resonant frequency of the first antenna section and the resonant frequency of the second antenna section change simultaneously. That is, with the frequency-changing circuit, it is possible to simultaneously change a plurality of resonant frequencies by a desired range. When a wide bandwidth is to be achieved using a single-resonance antenna, it is necessary to apply a large control voltage to a frequency changing circuit so that a resonant frequency can be changed over a wide range. In contrast, with the antenna according to a preferred embodiment of the present invention, it is possible to simultaneously change a plurality of resonant frequencies with different frequencies using a low control voltage. Thus, it is possible to achieve a wide bandwidth using a low control voltage.

It is preferable that the second reactance circuit has a reactance that is variable according to the control voltage.

With the configuration described above, the reactance of the second reactance circuit can be changed according to the control voltage by a desired range, so that the resonant frequency of the first antenna section can be changed to various values.

Alternatively, the second reactance circuit may have a reactance that is fixed.

With the configuration described above, the reactance of the frequency-changing circuit is the sum of the variable reactance of the first reactance circuit and the fixed reactance of the second reactance circuit. Thus, when the reactance of the first reactance circuit is changed, the resonant frequencies of the first and second antenna sections change simultaneously.

The first reactance circuit preferably is a series circuit including a variable capacitor or a parallel circuit including a variable capacitor, wherein the second reactance circuit is a series circuit including a variable capacitor or a parallel circuit including a variable capacitor, and wherein terminals of the variable capacitors of the first and second reactance circuits, the terminals having the same polarity, are connected to each other so as to define a node between the first and second reactance circuits, and the control voltage is applied to the node to control capacitances of the variable capacitors.

The first reactance circuit may also preferably be a series circuit including a variable capacitor or a parallel circuit including a variable capacitor, wherein the second reactance circuit is a series circuit including a fixed capacitor or a parallel circuit including a fixed capacitor, and wherein the variable capacitor of the first reactance circuit is connected to the second reactance circuit so as to define a node between the first and second reactance circuits, and the control voltage is applied to the node to control a capacitance of the variable capacitor.

An inductor may also be connected in parallel to the first reactance circuit and the second reactance circuit across the first and second reactance circuits.

With the configuration described above, by using the inductor, a third antenna section is provided, which resonates in a frequency band lower than the frequencies covered by the first antenna section and the second antenna section.

The additional radiating electrode preferably branches from the node via an inductor so as to control a resonant frequency.

One or more additional radiating electrodes that are separate from the earlier mentioned additional radiating electrode may be arranged so as to branch from the node.

With the configuration described above, it is possible to achieve further multiple resonances.

Each of the one or more separate additional radiating electrodes is preferably arranged to branch from the node via another reactance circuit having the same configuration as the first reactance circuit, and another control voltage for controlling a capacitance of a variable capacitor of the another reactance circuit is applied to the another reactance circuit.

With the configuration described above, the resonant frequencies of antenna sections associated with individual additional radiating electrodes can be freely changed independently among the antenna sections.

An additional radiating electrode that is separate from the earlier mentioned additional radiating electrode may be preferably connected to a middle portion of the radiating electrode.

The separate additional radiating electrode may also be preferably connected to the radiating electrode via an inductor.

The first antenna section may preferably have a shape of a loop in which the feeding electrode and the open distal end of the radiating electrode are opposed via a gap.

With the configuration described above, the reactance of the first antenna section can be changed by changing the gap between the feeding electrode and the open distal end of the radiating electrode.

All or one or more of the antenna element including the feeding electrode, the frequency-changing circuit, the radiating electrode, and the additional radiating electrode may be preferably disposed on a dielectric base.

With the configuration described above, the reactances of the first and second antenna sections can be changed by changing the dielectric constant of the dielectric base.

In one or more or all of the radiating electrode of the first antenna section, the additional radiating electrode of the second antenna section, and the one or more separate additional radiating electrodes, a middle portion or an open distal end of the electrode may preferably be connected to a ground via a discrete inductor or a reactance circuit.

With the configuration described above, a new resonance based on the discrete inductor or the reactance circuit can be obtained.

The reactance circuit preferably is a series resonance circuit or a parallel resonance circuit, or a composite circuit including a series resonance circuit and a parallel resonance circuit.

The antenna may preferably be configured to allow reception of FM electromagnetic waves, electromagnetic waves in the VHF band, and electromagnetic waves in the UHF band.

A wireless communication device according to another preferred embodiment of the present invention preferably includes the antenna.

As described above in detail, with the antennas according to preferred embodiments of the present invention, it is possible to achieve multiple resonances. Furthermore, advantageously, it is possible to achieve a wide bandwidth at a low control voltage. Thus, application to a wireless communication device or the like for which a low power-supply voltage is required, such as a cellular phone, is possible.

Particularly, since in at least one of the preferred embodiments of the present invention, the second reactance circuit of the frequency-changing circuit is also of the variable type, the resonant frequency of the first antenna section can be changed to even more varied values.

With the antenna according to another preferred embodiment of the present invention, since the second reactance circuit of the frequency-changing circuit is of the fixed type, it is possible to change the resonant frequencies of the first and antenna sections by different amounts at a low cost.

With the antenna according to yet another preferred embodiment of the present invention, by using an additional inductance, a third antenna is defined to include the feeding electrode, the inductor, and the radiating electrode. Thus, a band of a low resonant frequency is newly obtained.

With the antenna according to yet another preferred embodiment of the present invention, it is possible to achieve further multiple resonances. Thus, a multi-band antenna compatible with multimedia can be provided.

With the antenna according to yet another preferred embodiment of the present invention, each of the resonant frequencies can be changed to various values.

With the antennas of various preferred embodiments of the present invention, it is possible to add a new resonance while maintaining a small cubic size of the antenna.

In one particular preferred embodiment of the present invention, when the reactance circuit is implemented by a series resonance circuit, the effect on the resonant frequency of the electrode connected to the series resonance circuit can be reduced. When the reactance circuit is implemented by a parallel resonance circuit, the constant of a load inductor can be reduced, so that the problem of a chip component regarding the self-resonant frequency can be solved. When the reactance circuit is implemented by a composite circuit including a series resonance circuit and a parallel resonance circuit, it is possible to achieve both the advantage of the series resonance circuit and the advantage of the parallel resonance circuit.

In another preferred embodiment of the present invention, a wireless communication device that allows transmission and reception in a wide band at a low voltage can be provided.

Other features, elements, steps, characteristics and advantages of the present invention will be described below with reference to preferred embodiments thereof and the attached drawings.

DETAILED DESCRIPTION OF PREFERRED EMBODIMENTS

Now, the best mode of the present invention will be described with reference to the drawings.

First Preferred Embodiment

Figure 1:
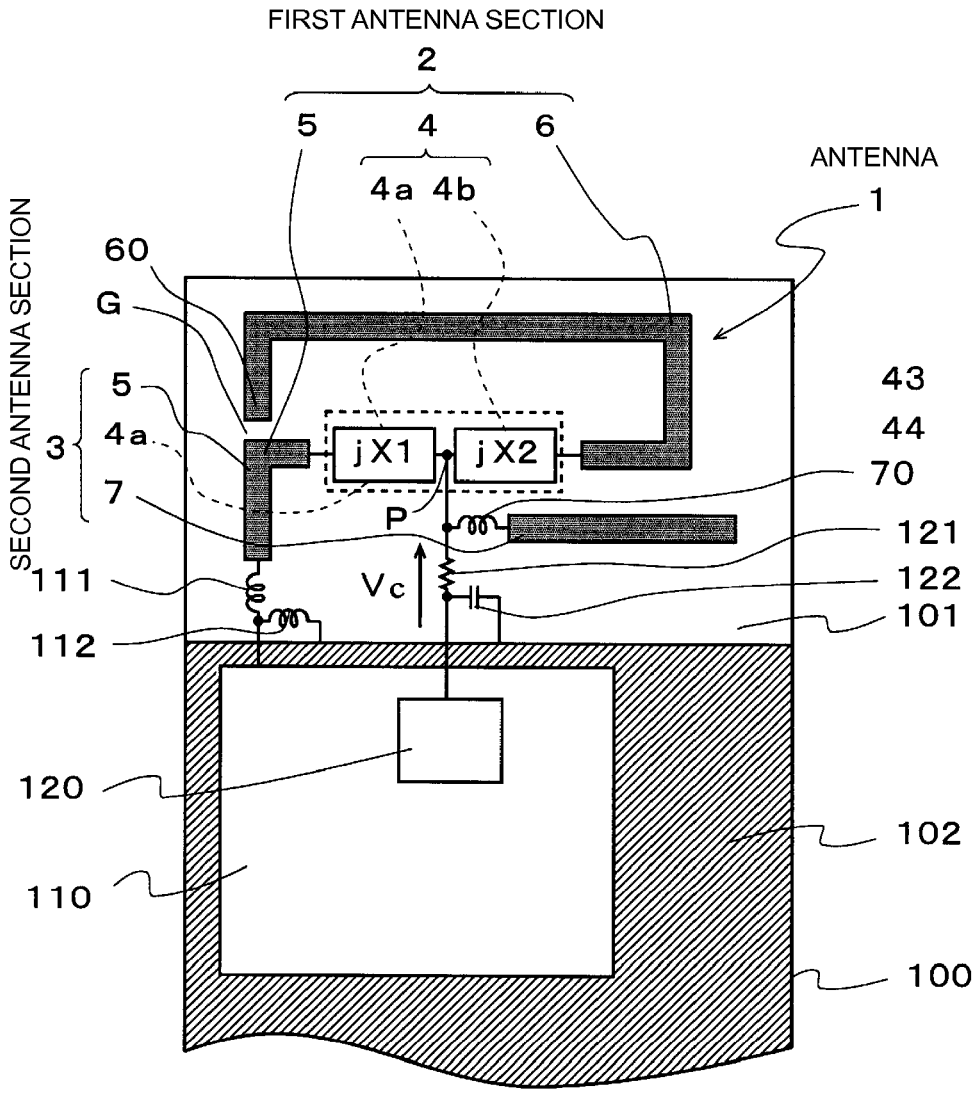
FIG. 1 is a schematic plan view showing an antenna according to a first preferred embodiment of the present invention.

FIG. 1 is a schematic plan view showing an antenna according to a first preferred embodiment of the present invention.

An antenna 1 according to this preferred embodiment is preferably provided on a wireless communication device, such as a cellular phone.

As shown in FIG. 1, an antenna 1 is provided in a non-ground region 101 of a circuit board 100 of the wireless communication device, and the antenna 1 exchanges high-frequency signals with a transceiver 110 mounted on a ground region 102. Furthermore, a DC control voltage Vc is input to the antenna 1 from a reception-frequency controller 120 provided in the transceiver 110.

The antenna 1 includes a first antenna section 2 and a second antenna section 3, and the first and second antenna sections 2 and 3 share a frequency-changing circuit 4.

In the first antenna section 2, a radiating electrode 6 is connected to a feeding electrode 5 via the frequency-changing circuit 4. More specifically, a matching circuit constituted by inductors 111 and 112 is disposed on the non-ground region 101, and the feeding electrode 5 defined by a conductor pattern is connected to the transceiver 110 via the matching circuit. That is, the feeding electrode 5 constitutes a feeding section of the first antenna section 2. The radiating electrode 6 is preferably defined by a conductor pattern connected to the feeding electrode 5 via the frequency-changing circuit 4, with an open distal end 60 thereof opposing the feeding electrode 5 via a certain gap G. Thus, the first antenna section 2 defines a loop as a whole. Since the gap G causes a capacitance between the feeding electrode 5 and the radiating electrode 6, the reactance of the first antenna section 2 can be changed to a desired value by changing the size of the gap G.

The frequency-changing circuit 4 is disposed between the feeding electrode 5 and the radiating electrode 6 of the first antenna section 2. The frequency-changing circuit 4 allows changing the resonant frequency of the first antenna section 2 by changing its reactance value and thereby changing the electrical length of the first antenna section 2.

The frequency-changing circuit 4 has a circuit configuration in which a first reactance circuit 4*a* (denoted as "jX1" in FIG. 1), which is connected to the feeding electrode 5, is connected to a second reactance circuit 4*b* (denoted as "jX2" in FIG. 1) connected to the radiating electrode 6. A reactance of the first reactance circuit 4*a* can be changed according to the control voltage Vc.

The first reactance circuit 4*a* is a series circuit including a variable capacitor or a parallel circuit including a variable capacitor.

The second reactance circuit 4*b* is a circuit whose reactance can be controlled according to the control voltage Vc, i.e., a series circuit including a variable capacitor or a parallel circuit including a variable capacitor, or a circuit whose reactance is fixed, i.e., a series circuit including a fixed capacitor or a parallel circuit including a fixed capacitor.

A node P between the first reactance circuit 4*a* and the second reactance circuit 4*b* is connected to the reception-frequency controller 120 via a high-frequency-cut resistor 121 and a DC-pass capacitor 122.

Thus, when the control voltage Vc from the reception-frequency controller 120 is applied to the node P, the reactances of the first and second reactance circuits 4*a* and 4*b* change according to the magnitude of the control voltage Vc.

The second antenna section 3 includes an additional radiating electrode 7 and the feeding electrode 5. The additional radiating electrode 7 having an open distal end is connected in the middle of the frequency-changing circuit 4.

More specifically, the additional radiating electrode 7 of the conductor pattern is connected to the node P between the first and second reactance circuits 4*a* and 4*b* via a resonant-frequency adjusting inductor 70. Thus, the second antenna section 3 includes and is preferably defined by the feeding electrode 5, the first reactance circuit 4*a* of the frequency-changing circuit 4, and the additional radiating electrode 7. When the reactance of the first reactance circuit 4*a* of the frequency-changing circuit 4 changes by applying the control voltage Vc to the node P, the electrical length of the second antenna section 3 changes, whereby the resonant frequency of the second antenna section 3 changes.

Next, the operation and advantages exhibited by the antenna according to this preferred embodiment will be described.

Figure 2:
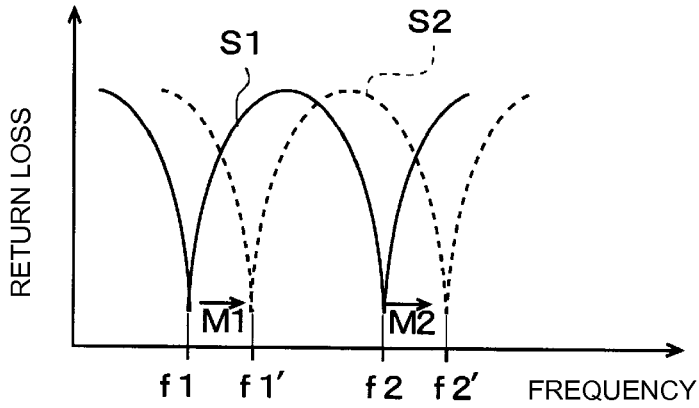
FIG. 2 is a diagram for explaining the variable states of multiple resonances.
Figure 3A:
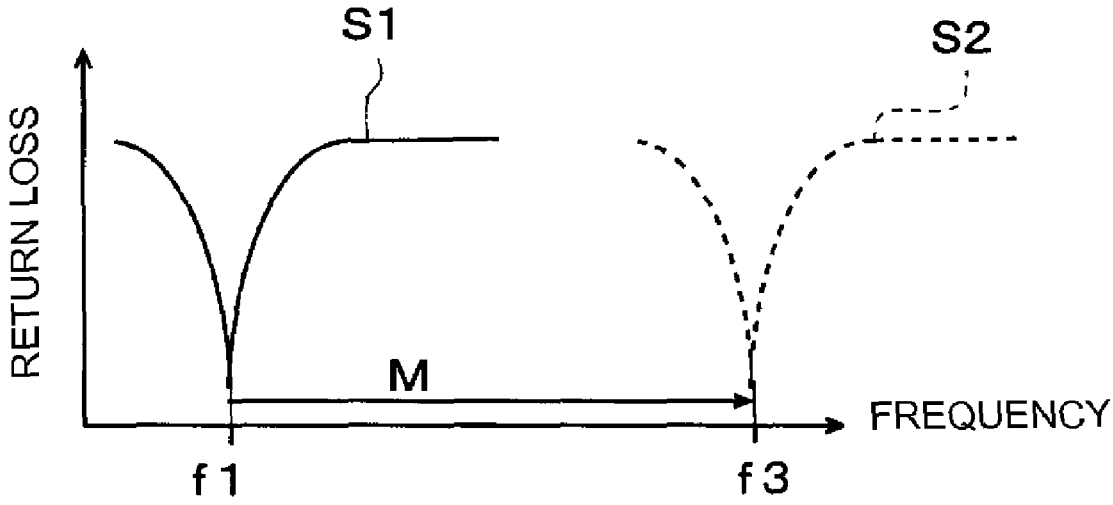
FIG. 3A and FIG. 3B are diagrams for explaining that a wide bandwidth can be achieved at a low voltage.

FIG. 2 is a diagram for explaining the variable states of multiple resonances, and FIGS. 3A. and 3B are diagrams for explaining that a wide bandwidth can be achieved at a low voltage.

Since the first antenna section 2 includes and is defined by the feeding electrode 5, the frequency-changing circuit 4, and the radiating electrode 6, and the second antenna section 3 includes and is defined by the feeding electrode 5, the first reactance circuit 4*a* of the frequency-changing circuit 4, and the additional radiating electrode 7 as described above, two resonant states of a resonant frequency f1 associated with the first antenna section 2 and a resonant frequency f2 associated with the second antenna section 3 can be achieved. With a design in which the length of the radiating electrode 6 is longer than the length of the additional radiating electrode 7, the resonant frequency f1 associated with the first antenna section 2 becomes lower than the resonant frequency f2 associated with the second antenna section 3, so that a return-loss curve S1 represented by a solid line in FIG. 2 is obtained. Thus, when the second reactance circuit 4*b* is a variable circuit that can be controlled according to the control voltage Vc as described earlier, by applying the control voltage Vc from the reception-frequency controller 120 to the node P of the frequency-changing circuit 4, the reactances of the first and second reactance circuits 4*a* and 4*b* change, so that the electrical length of the first antenna section 2 changes. As a result, as indicated by a return-loss curve S2 represented by a broken line in FIG. 2, the resonant frequency f1 of the first antenna section 2 is shifted to a frequency f1' by an amount of change M1 corresponding to the magnitude of the control voltage Vc. At the same time, the resonant frequency f2 of the second antenna section 3 is shifted to a frequency f2' by an amount of change M2 corresponding to change in the reactance of a variable-capacitance diode 42. Thus, through the design of parts of the first and second reactance circuits 4*a* and 4*b*, it is possible to make the amount of change M1 of the resonant frequency f1 and the amount of change M2 of the resonant frequency f2 equal or different and to change the resonant frequencies f1 and f2 within desired ranges. Since the reactance of the second reactance circuit 4*b* is also variable, it is possible to change the resonant frequency f1 of the first antenna section 2 to various values.

Figure 3B:
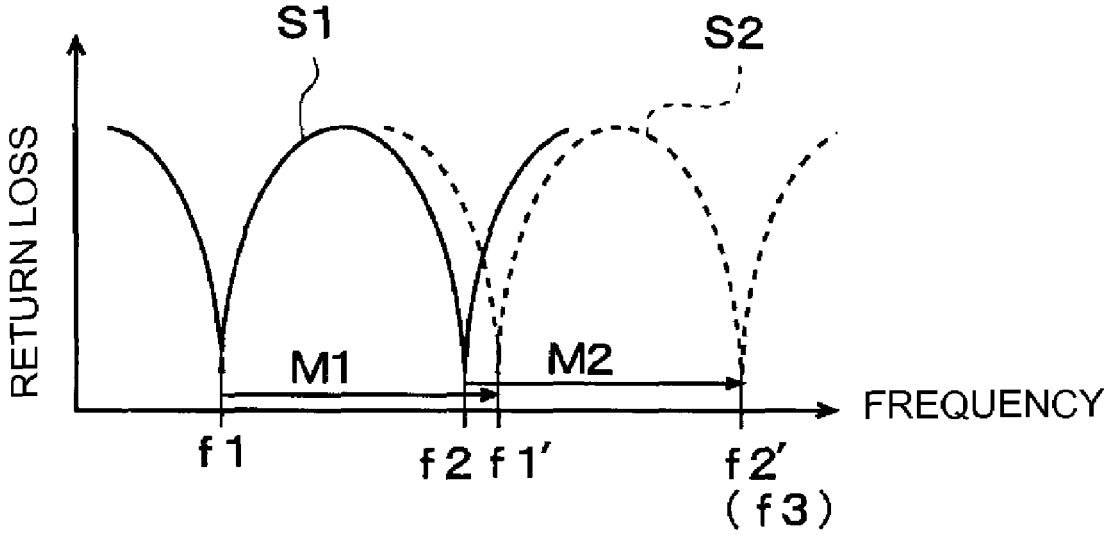

Furthermore, with the antenna 1 according to this preferred embodiment, it is possible to achieve a wide bandwidth with the control voltage Vc at a low voltage. More specifically, as shown in part (a) of FIG. 3, when it is attempted to achieve a wide bandwidth so as to allow transmission and reception at frequencies f1 to f3 using a single-resonance antenna with the resonant frequency f1 alone, it is necessary to apply a large control voltage Vc to a frequency-changing circuit to change the resonant frequency f1 by an amount of change M so that the resonant frequency f1 ranges from the frequency f1 to the frequency f3. Thus, this type of antenna is not suitable for a wireless communication device such as a cellular phone, for which low-voltage operation is required.

In contrast, in the antenna 1 according to this preferred embodiment of the present invention, the resonant frequencies f1 and f2 of two resonant states can be changed simultaneously according to the control voltage Vc. Thus, as shown in part (b) of FIG. 3, transmission and reception with a wide bandwidth corresponding to the frequencies f1 to f3 are allowed by changing the resonant frequency f2 up to a desired frequency f2' (=f3) and changing the resonant frequency f1 up to a frequency f1' that is higher than or equal to a lowest frequency f2 of the resonant frequency f2. At this time, the amounts of change of the resonant frequencies f1 and f2 are M1 and M2, respectively, and each of the amounts of change is much smaller than the amount of change M in the case of single resonance. That is, in the antenna 1, transmission and reception with a wide bandwidth corresponding to the frequencies f1 to f3 are allowed since the resonant frequencies f1 and f2 can be changed within the range of the frequencies f1 to f3 according to a low control voltage Vc that causes changes by the slight amounts of change M1 and M2. Accordingly, using the antenna 1, transmission and reception with a wide bandwidth are allowed even in a wireless communication device or the like, for which low-voltage operation is required.

Furthermore, in the antenna 1, when a control voltage Vc having the same magnitude as in the case of single resonance is applied to the frequency-changing circuit 4, transmission and reception in a wide range far exceeding the frequencies f1 to f3 are allowed. Depending on the design of parts of the frequency-changing circuit 4, it is possible to achieve a bandwidth that is double or even wider than the bandwidth in the case of single resonance.

Second Preferred Embodiment

Figure 4:
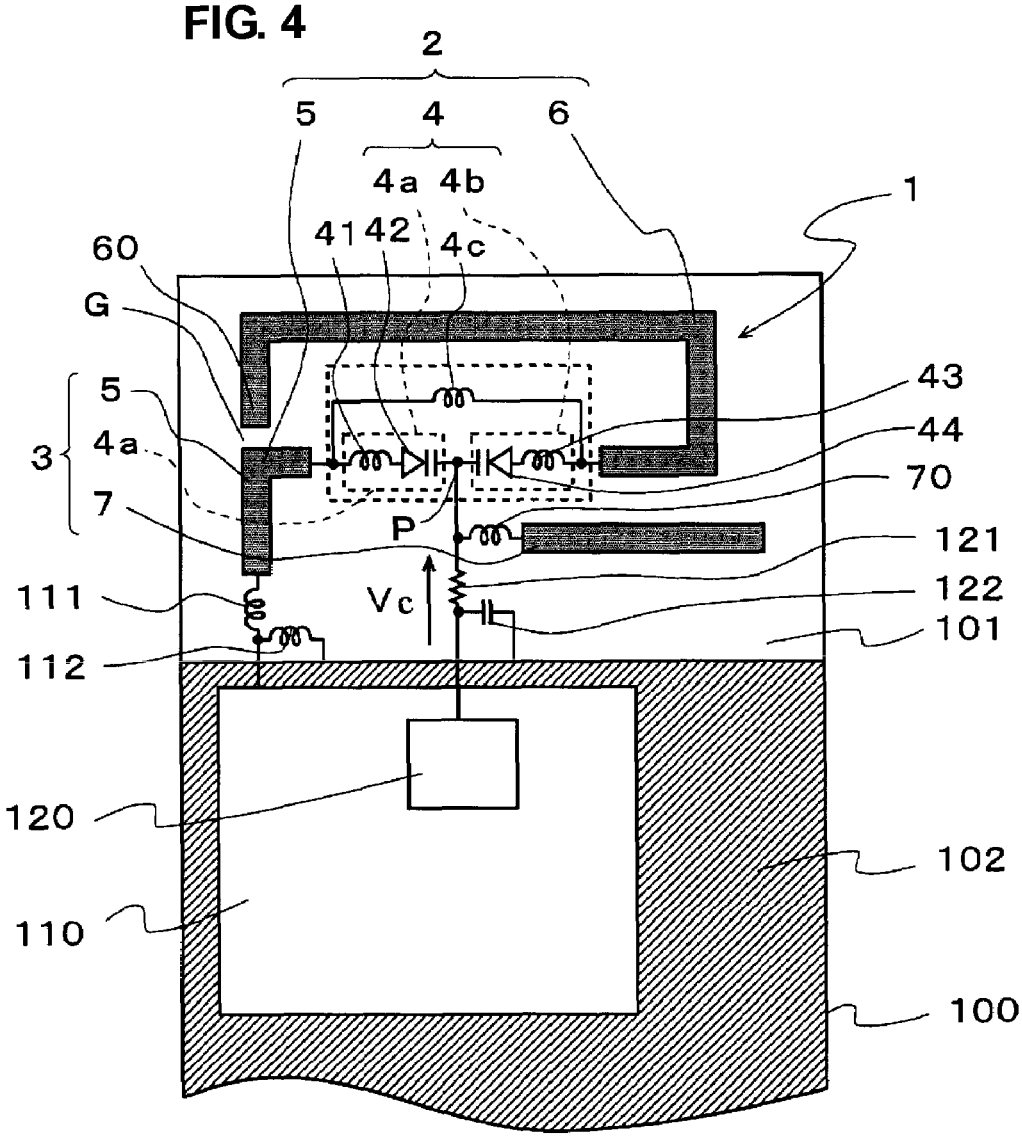
FIG. 4 is a schematic plan view showing an antenna according to a second preferred embodiment of the present invention.
Figure 5A:
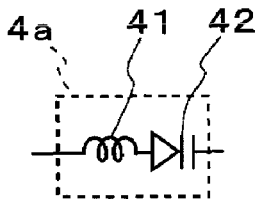
FIG. 5A and FIG. 5B are circuit diagrams showing examples of a first reactance circuit including a series circuit.
Figure 5B:
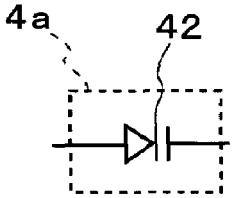
Figure 6A:
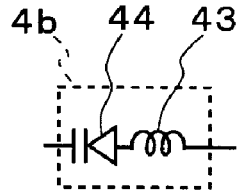
FIGS. 6A-6D are circuit diagrams showing examples of a second reactance circuit of the variable type.
Figure 6B:
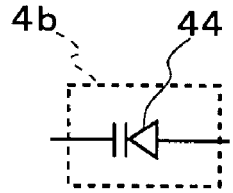
Figure 6C:
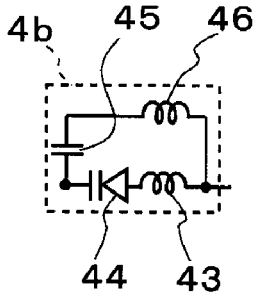
Figure 6D:
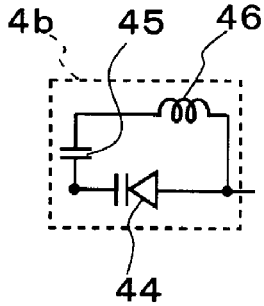

FIG. 4 is a schematic plan view showing an antenna according to a second preferred embodiment of the present invention. FIGS. 5A and 5B are circuit diagrams showing specific examples of the first reactance circuit 4*a* preferably includes a series circuit, and FIGS. 6A-6D are circuit diagrams showing specific examples of the second reactance circuit 4*b* of the variable type.

In an antenna 1 according to this preferred embodiment, specific variable series circuits are used as the first reactance circuit 4*a* and the second reactance circuit 4*b* in the first embodiment.

The first reactance circuit 4*a* preferably is a series circuit including a variable capacitor or a parallel circuit including a variable capacitor. In this preferred embodiment, a series circuit including a variable capacitor is used. The series circuit including a variable capacitor may be a series circuit shown in part (a) or (b) of FIG. 5. In this example, the series circuit shown in part (a) of FIG. 5 is used.

The second reactance circuit 4*b* is a series circuit including a variable capacitor or a parallel circuit including a variable capacitor, or a series circuit including a fixed capacitor or a parallel circuit including a fixed capacitor. In this preferred embodiment, a series circuit including a variable capacitor or a parallel circuit including a variable capacitor is used. The series circuit including a variable capacitor or a parallel circuit including a variable capacitor may be any of circuits shown in parts (a) to (d) of FIG. 6. In this example, the series circuit shown in part (a) of FIG. 6, which is a variable circuit, is used.

More specifically, as shown in FIG. 4, the first reactance circuit 4*a* preferably includes a series circuit in which an inductor 41 connected to the feeding electrode 5 is connected to the anode side of a variable-capacitance diode 42 as a variable capacitor, and the second reactance circuit 4*b* includes of a series circuit in which an inductor 43 connected to the radiating electrode 6 is connected to the anode side of a variable-capacitance diode 44 as a variable capacitor. The terminals of the variable-capacitance diodes 42 and 44 with the same polarity (the cathodes thereof) are connected to each other, and a node P therebetween is connected to the reception-frequency controller 120 via the high-frequency-cut resistor 121 and the DC-pass capacitor 122. Since the potentials at the anode sides of the variable-capacitance diodes 42 and 44 must be both zero, an inductor 4*c* is connected between an end of the inductor 41 on the side of the feeding electrode 5 and an end of the inductor 43 on the side of the radiating electrode 6.

Thus, when the control voltage Vc is applied from the reception-frequency controller 120 to the node P of the frequency-changing circuit 4, the capacitances of the variable-capacitance diodes 42 and 44 change and therefore the electrical length of the first antenna section 2 changes, so that the resonant frequency of the first antenna section 2 is shifted to a resonant frequency corresponding to the magnitude of the control voltage Vc. At the same time, the resonant frequency of the second antenna section 3 is shifted in accordance with change in the reactance of the variable-capacitance diode 42.

In this preferred embodiment, as the second reactance circuit 4*b* connected to the first reactance circuit 4*a* including a series-connection circuit, the circuit shown in part (a) of FIG. 6, in which the inductor 43 and the variable-capacitance diode 44 are connected in series, is used. However, without limitation thereto, any series circuit or parallel circuit including the variable-capacitance diode 44 may be used. Thus, any of the parallel circuits shown in part (d) of FIG. 6 may be used as the second reactance circuit 4*b*.

Third Preferred Embodiment

Next, a third preferred embodiment of the present invention will be described.

Figure 7:
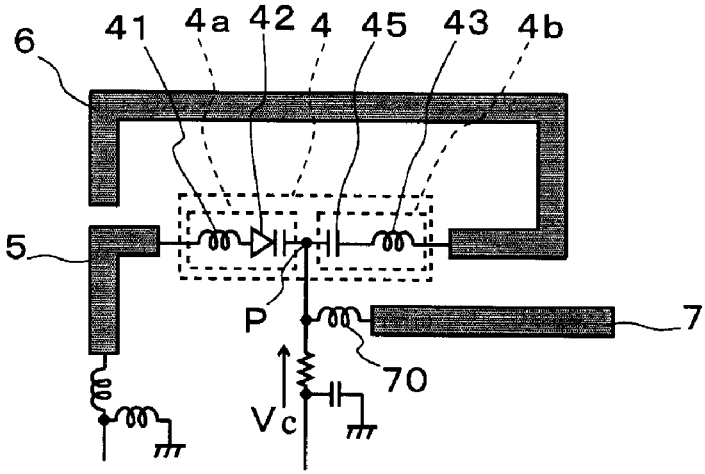
FIG. 7 is a schematic plan view showing an antenna according to a third preferred embodiment of the present invention.
Figure 8A:
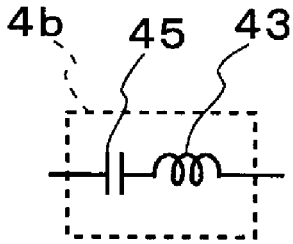
FIGS. 8A-8E are circuit diagrams showing examples of the second reactance circuit of the fixed type.
Figure 8B:
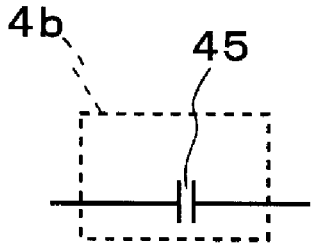
Figure 8C:
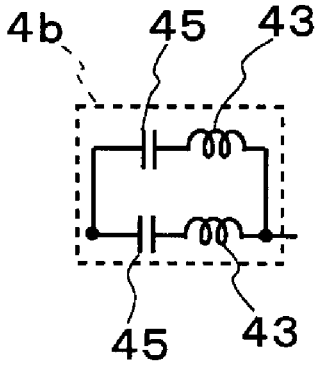
Figure 8D:
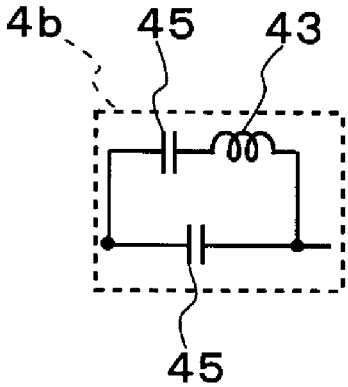
Figure 8E:
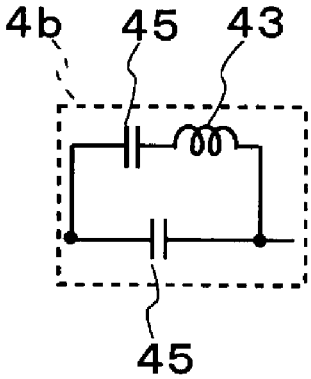

FIG. 7 is a schematic plan view showing an antenna according to the third preferred embodiment of the present invention. FIGS. 8A-8E are circuit diagrams showing specific examples of the second reactance circuit 4*b* of the fixed type.

In the second preferred embodiment described above, a series circuit including a variable capacitor is preferably used as the first reactance circuit 4*a*, and a series circuit including a variable capacitor or a parallel circuit including a variable capacitor is preferably used as the second reactance circuit 4*b*. In this preferred embodiment, as the second reactance circuit 4*b*, a series circuit including a fixed capacitor or a parallel circuit including a fixed capacitor is preferably used.

The series circuit including a fixed capacitor or the parallel circuit including a fixed capacitor may be any of circuits shown in parts (a) to (e) of FIG. 8. In this example, the series circuit shown in part (a) of FIG. 8, which is a fixed circuit, is used.

More specifically, as shown in FIG. 7, similarly to the first preferred embodiment described earlier, the first reactance circuit 4*a* of the frequency-changing circuit 4 preferably includes a series circuit of the inductor 41 and the variable-capacitance diode 42, and the second reactance circuit 4*b* preferably includes a series circuit of a capacitor 45 as a fixed capacitor and the inductor 43. Furthermore, the variable-capacitance diode 42 of the first reactance circuit 4*a* is connected to the capacitor 45 of the second reactance circuit 4*b*, and a control voltage Vc for controlling the capacitance of the variable-capacitance diode 42 is applied to a node P therebetween.

With the configuration described above, since the reactance of the second reactance circuit 4*b* is fixed, the variable-capacitance diode 44 or the like, which is expensive, is not needed, so that manufacturing cost is reduced accordingly.

The configuration, operation, and advantages are otherwise similar to those of the second preferred embodiment described earlier, so that description thereof will be omitted.

Figure 9:
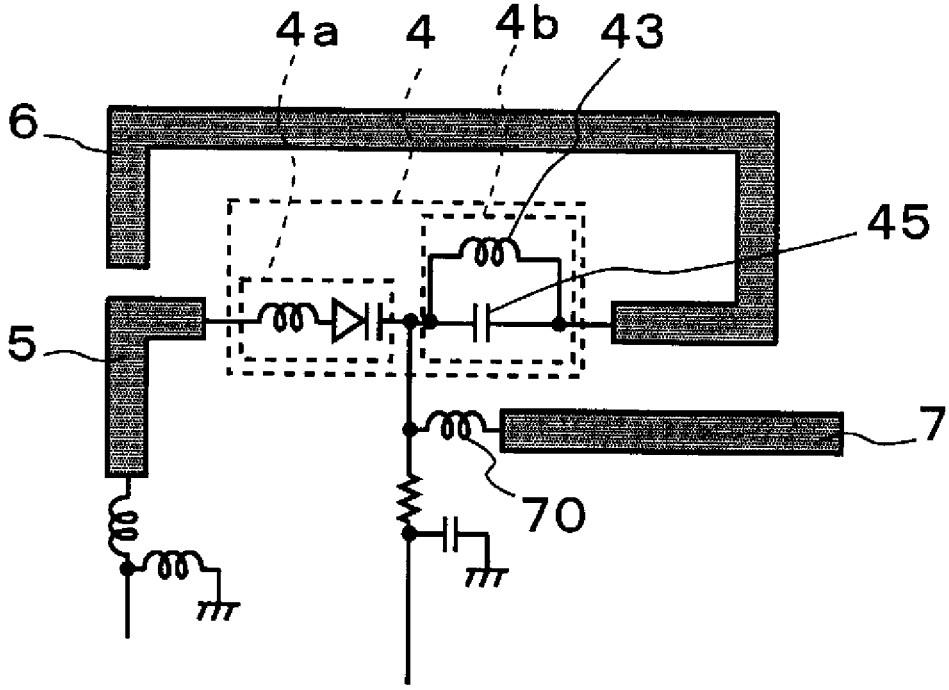
FIG. 9 is a schematic plan view showing a modification of the third preferred embodiment of the present invention.

In the present preferred embodiment, the circuit shown in part (a) of FIG. 8, in which the inductor 43 and the capacitor 45 are connected in series, is preferably used as the second reactance circuit 4*b* connected in series with the first reactance circuit 4*a* including a series-connection circuit. However, without limitation thereto, any series circuit or parallel circuit including the capacitor 45 may be used. Thus, the parallel circuit shown in part (e) of FIG. 8 may be used. That is, by forming the second reactance circuit 4*b* of a parallel circuit in which the inductor 43 and the capacitor 45 are connected in parallel and connecting the cathode side of the variable-capacitance diode 42 to the second reactance circuit 4*b* as shown in FIG. 9, it is possible to achieve operation and advantages similar to those in this preferred embodiment.

Fourth Preferred Embodiment

Next, a fourth preferred embodiment of the present invention will be described.

Figure 10:
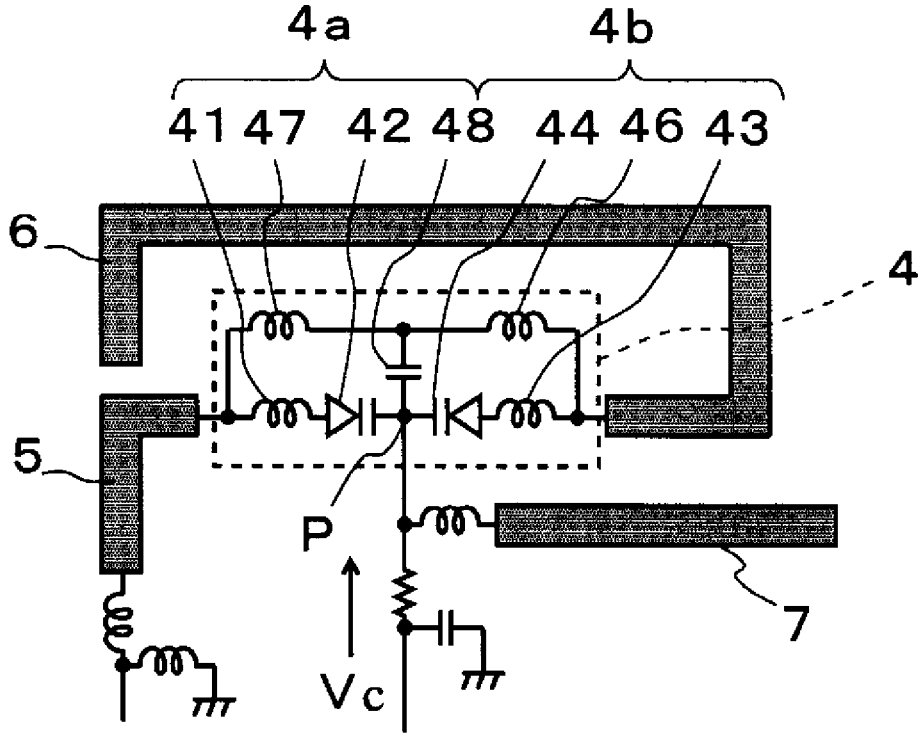
FIG. 10 is a schematic plan view showing an antenna according to a fourth preferred embodiment of the present invention.
Figure 11A:
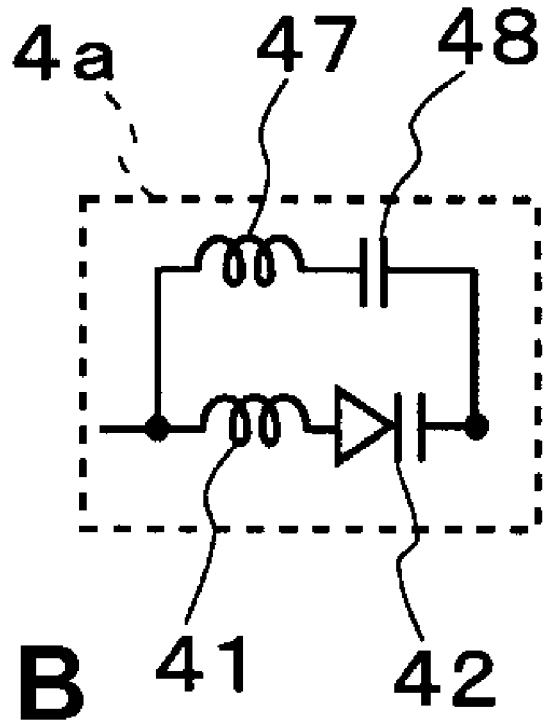
FIG. 11A and FIG. 11B are circuit diagrams showing examples of the first reactance circuit including a parallel circuit.
Figure 11B:
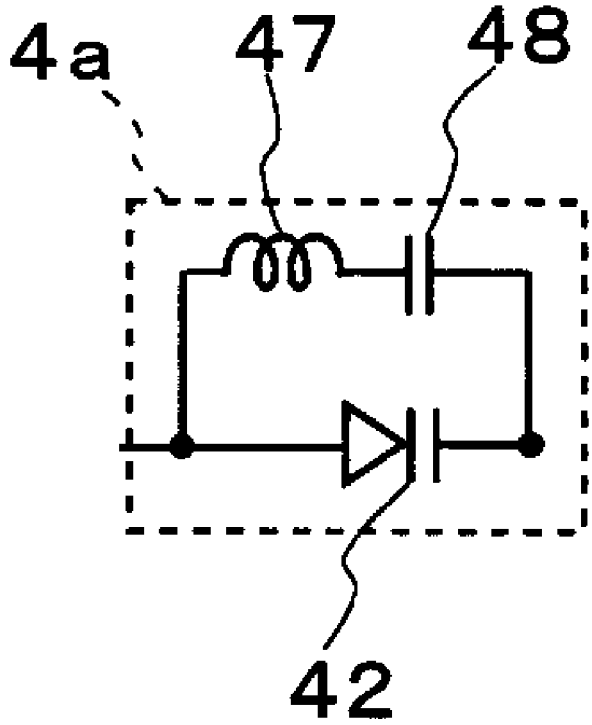

FIG. 10 is a schematic plan view showing an antenna according to the fourth preferred embodiment of the present invention, and FIGS. 11A and 11B are circuit diagrams showing specific examples of the first reactance circuit 4*a* including a parallel circuit.

In the second and third preferred embodiments described above, a series circuit including a variable capacitor is preferably used as the first reactance circuit 4*a*. In the present preferred embodiment, a parallel circuit including a variable capacitor is preferably used as the first reactance circuit 4*a*.

The parallel circuit including a variable capacitor may be any of circuits shown in parts (a) and (b) of FIG. 11. In this example, the parallel circuit shown in part (a) of FIG. 11 is used.

More specifically, as shown in FIG. 10, the first reactance circuit 4*a* including a parallel circuit is preferably defined by connecting a series circuit including an inductor 47 and a shared capacitor 48 in parallel to a series circuit including the inductor 41 and the variable-capacitance diode 42. Furthermore, regarding the second reactance circuit 4*b*, similarly, the second reactance circuit 4*b* including a parallel circuit is defined by connecting a series circuit including an inductor 46 and the shared capacitor 48 in parallel to a series circuit including the inductor 43 and the variable-capacitance diode 44.

Furthermore, the terminals of the variable-capacitance diodes 42 and 44 with the same polarity are connected to each other, a control voltage Vc for controlling the capacitances of the variable-capacitance diodes 42 and 44 is applied to a node P therebetween.

With the configuration described above, since the first reactance circuit 4*a* of the frequency-changing circuit 4 includes a parallel circuit, compared with the case where a series circuit is used, the reactance of the first reactance circuit 4*a* can be changed more extensively.

Furthermore, by using one of the inductors 46 and 47 as a choke coil, it is possible to configure one of the first and second reactance circuits 4*a* and 4*b* as a reactance circuit including a series circuit and to configure the other as a reactance circuit including a parallel circuit. Thus, for example, by using the inductor 46 as a choke coil, the second antenna section 3 preferably includes and is defined by the feeding electrode 5, the series circuit of the inductor 41 and the variable-capacitance diode 42, and the additional radiating electrode 7, and the setting and variable range of the resonant frequency f2 are determined under this condition. The capacitor 48 functions as a DC-cut capacitor.

The configuration, operation, and advantages are otherwise similar to those of the second and third preferred embodiments described earlier, so that description thereof will be omitted.

Figure 12A:
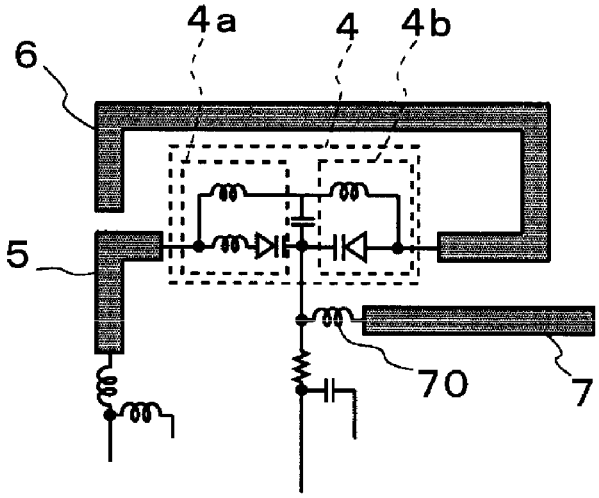
FIGS. 12A-12C are schematic plan views showing modifications of the fourth preferred embodiment, and part (a) of FIG. 12 shows a first modification, part (b) of FIG. 12 shows a second modification, and part (c) of FIG. 12 shows a third modification.
Figure 12B:
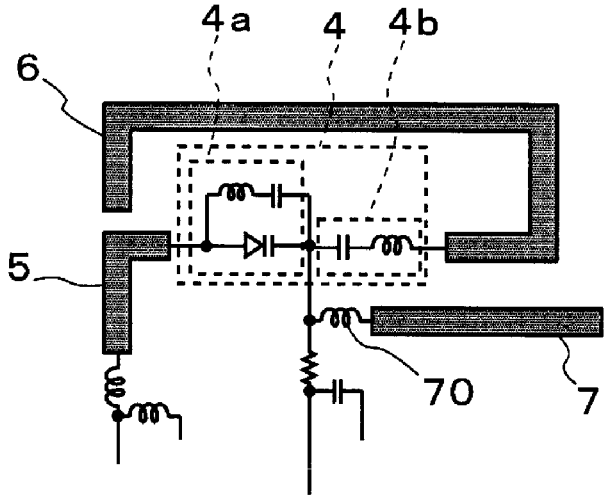
Figure 12C:
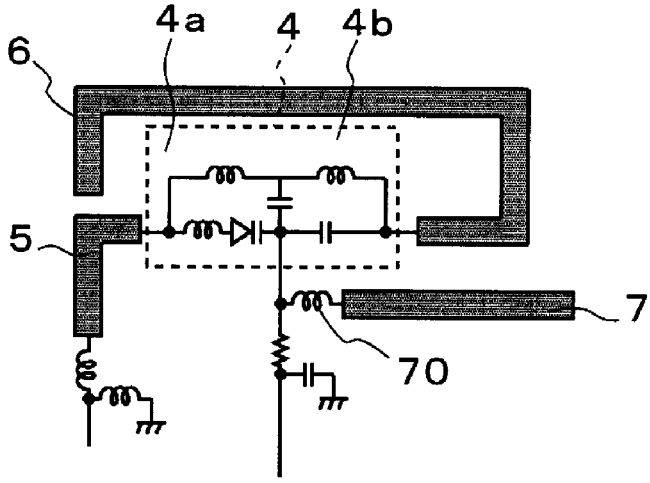

In this preferred embodiment, as an example, the parallel circuit shown in part (c) of FIG. 8 is connected as the second reactance circuit 4*b* connected to the first reactance circuit 4*a* including a parallel circuit. However, without limitation thereto, any of the circuits shown in FIGS. 6 and 8 may be used as the second reactance circuit 4*b*. Thus, modifications shown in FIGS. 12A-12C are possible. That is, as a combination of connection of the first reactance circuit 4*a* and the second reactance circuit 4*b*, for example, a combination of the parallel circuit shown in FIG. 11(*a*) and the variable parallel circuit shown in part (d) of FIG. 6, shown in part (a) of FIG. 12, a combination of the parallel circuit shown in part (b) of FIG. 11 and the fixed series circuit shown in part (a) of FIG. 8, shown in part (b) of FIG. 12, or a combination of the parallel circuit shown in part (a) of FIG. 11 and the fixed parallel circuit shown in part (d) of FIG. 8, may be used.

Fifth Preferred Embodiment

Next, a fifth preferred embodiment of the present invention will be described.

Figure 13:
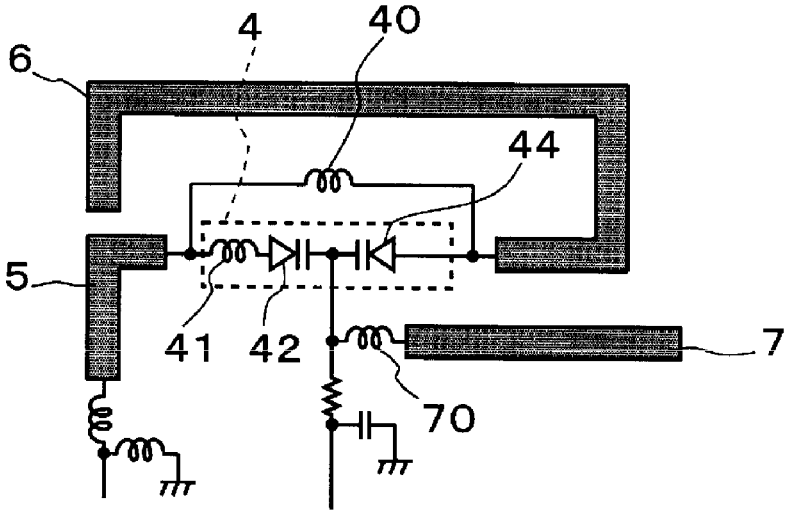
FIG. 13 is a schematic plan view showing an antenna according to a fifth preferred embodiment of the present invention.
Figure 14A:
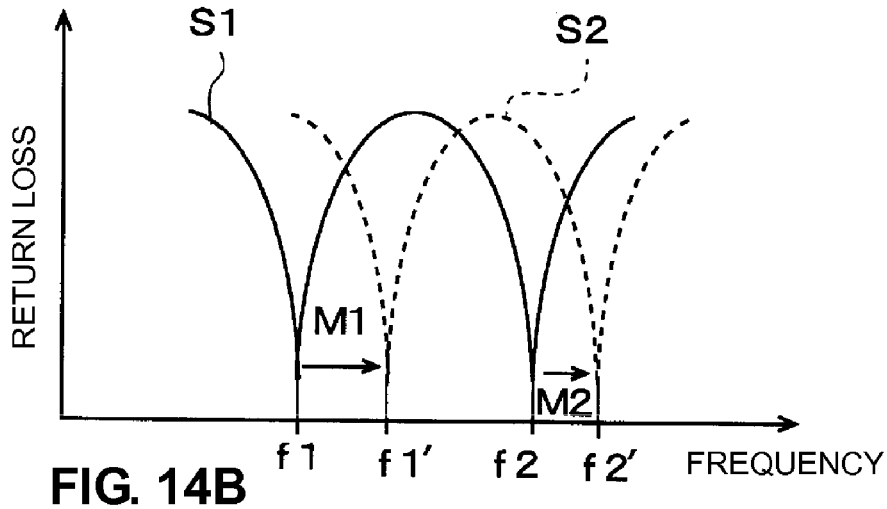
FIG. 14A and FIG. 14B are diagrams showing curves representing return loss that is caused due to the characteristics of an added inductor, and part (a) of FIG. 14 shows a case where the inductor is provided as a choke coil, and part (b) of FIG. 14 shows a case where the inductor is provided to allow adjustment of a resonant frequency.
Figure 14B:
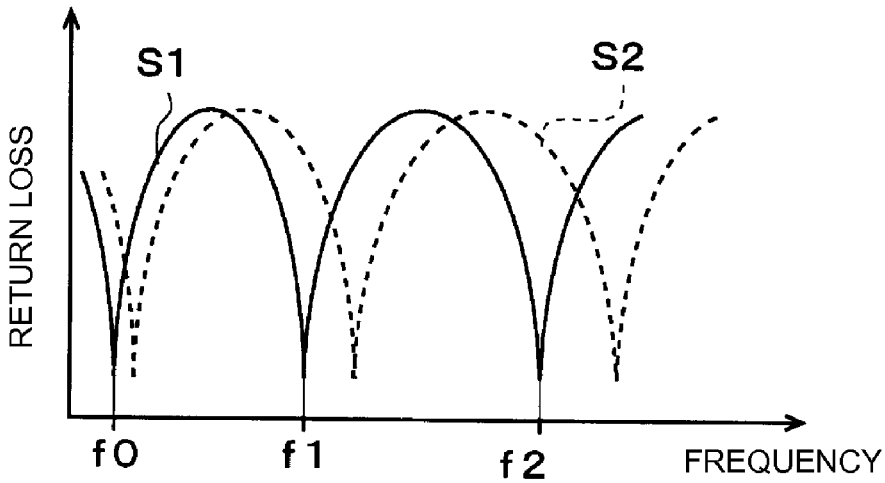

FIG. 13 is a schematic plan view showing an antenna according to the fifth preferred embodiment of the present invention. FIGS. 14A and 14B are diagrams showing curves representing return loss that is caused due to the characteristics of an added inductor. Part (a) of FIG. 14 shows a case where the inductor is provided as a choke coil, and part (b) of FIG. 14 shows a case where the inductor is provided to allow adjustment of the resonant frequency.

The present preferred embodiment differs from the first to fourth preferred embodiments in that an inductor 40 is added in parallel across the first and second reactance circuits 4*a* and 4*b* of the frequency-changing circuit 4, as shown in FIG. 13.

In an example described below, the inductor 40 is connected to the frequency-changing circuit 4 in which the variable series circuit shown in part (a) of FIG. 5 is used as the first reactance circuit 4*a* and in which the variable circuit shown in part (b) of FIG. 6 is used as the second reactance circuit 4*b*.

That is, the inductor 40 is disposed between the feeding electrode 5 and the radiating electrode 6, and the ends of the inductor 40 are connected respectively to the cathode sides of the variable-capacitance diodes 42 and 44.

Thus, with the inductor 40 provided as a choke coil, noise can be removed from the band, and it is possible to greatly shift only an arbitrary resonant frequency. Thus, as indicated by a return-loss curve S1 represented by a solid line and a return-loss curve S2 represented by a broken line in part (a) of FIG. 14, it is possible to shift only the resonant frequency f1 so that the amount of change M1 of the resonant frequency f1 is larger than the amount of change M2 of the resonant frequency f2.

Also, when the inductor 40 is provided to allow adjustment of the resonant frequency, it is possible to configure a third antenna section including the feeding electrode 5, the inductor 40, and the radiating electrode 6. As a result, as indicated by a return-loss curve S1 represented by the solid line in part (b) of FIG. 14, a new resonant frequency f0 associated with the third antenna section is generated in a frequency range that is lower than the resonant frequency f1 of the first antenna section 2, so that the low band is obtained. Also, as indicated by a return-loss curve S2 represented by a broken line, the resonant frequency f0 of the third antenna section can be changed arbitrarily by adjusting the inductance of the inductor 40.

The configuration, operation, and advantages are otherwise similar to those of the first to fourth preferred embodiments described earlier, so that description thereof will be omitted.

Figure 15A:
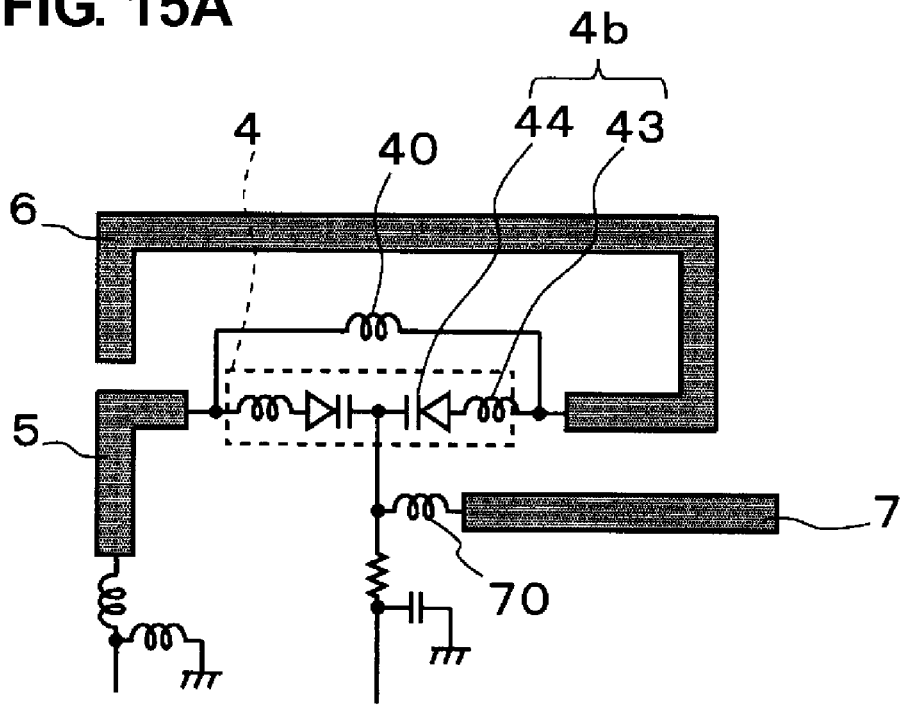
FIG. 15A and FIG. 15B are schematic plan views showing modifications of the fifth preferred embodiment, and part (a) of FIG. 15 shows a first modification, and part (b) of FIG. 15 shows a second modification.
Figure 15B:
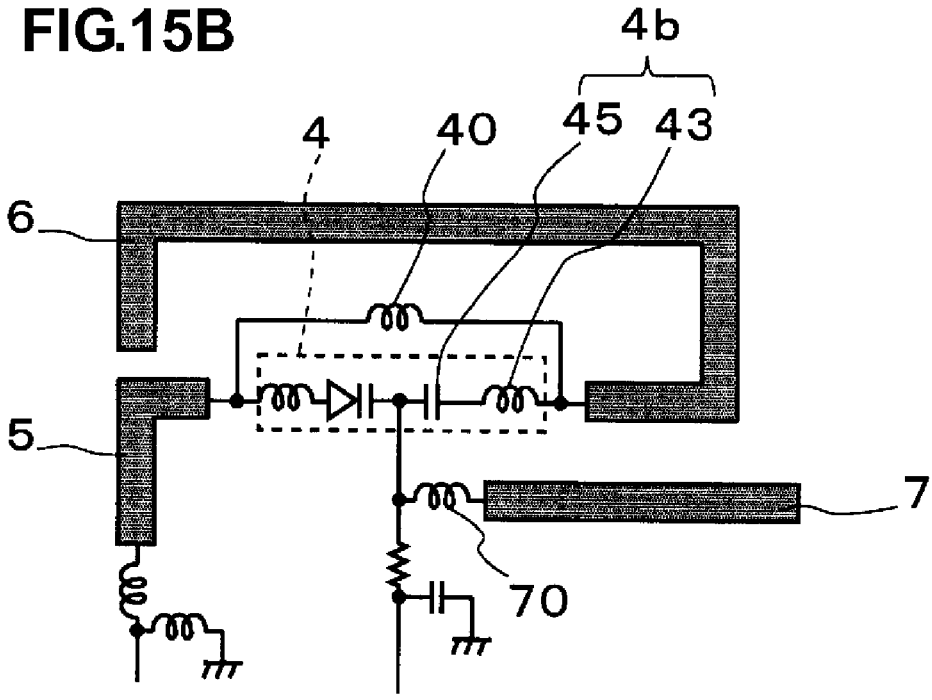

In the present preferred embodiment, the frequency-changing circuit 4 is preferably defined by using the variable series circuit shown in part (a) of FIG. 5 as the first reactance circuit 4*a* and using the variable circuit shown in part (b) of FIG. 6 as the second reactance circuit 4*b*. However, it suffices that the inductor 40 is added in parallel to and across the first and second reactance circuits 4*a* and 4*b*, and otherwise there is no limitation to the configuration of the frequency-changing circuit 4. Thus, an antenna shown in FIGS. 15A and 15B can be proposed.

That is, it is possible to achieve operation and advantages similar to those of this preferred embodiment by connecting the inductor 40 in parallel to the frequency-changing circuit 4 having the configuration according to the second preferred embodiment, as shown in part (a) of FIG. 15. Also, it is possible to achieve operation and advantages similar to those of this preferred embodiment by using a series circuit including the inductor 43 and the capacitor 45 as the second reactance circuit 4*b*, as shown in part (b) of FIG. 15.

Sixth Preferred Embodiment

Next, a sixth preferred embodiment of the present invention will be described.

Figure 16:
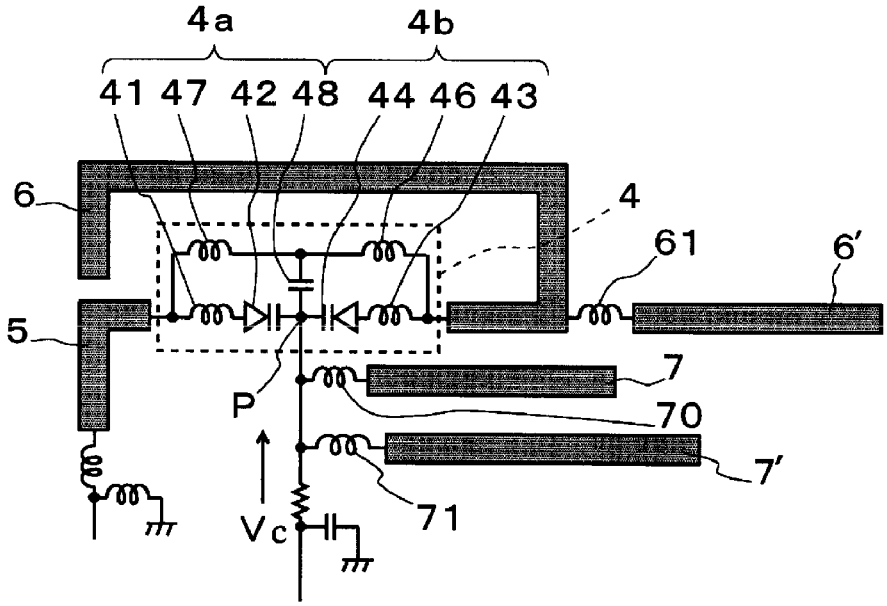
FIG. 16 is a schematic plan view showing an antenna according to a sixth preferred embodiment of the present invention.

FIG. 16 is a schematic plan view showing an antenna according to the sixth preferred embodiment of the present invention.

In this preferred embodiment, in addition to the configuration of the fourth preferred embodiment described earlier, an additional radiating electrode 7' separate from the additional radiating electrode 7 of the second antenna section 3 is connected to the node P via a resonant-frequency adjusting inductor 71, and an additional radiating electrode 6' is connected to the radiating electrode 6 via a resonant-frequency adjusting inductor 61. The control voltage Vc is applied to the node P.

Thus, a third antenna section includes and is defined by the feeding electrode 5, the first reactance circuit 4*a*, the resonant-frequency adjusting inductor 71, and the additional radiating electrode 7', and a fourth antenna section includes and is defined by the feeding electrode 5, the frequency-changing circuit 4, and the additional radiating electrode 6', so that a four-resonance antenna is provided. That is, it is possible to further increase the number of resonances, so that a multi-band antenna compatible with multimedia can be provided.

The configuration, operation, and advantages are otherwise the same as those of the preferred embodiments described earlier, so that description thereof will be omitted.

Seventh Preferred Embodiment

Next, a seventh preferred embodiment of the present invention will be described.

Figure 17:
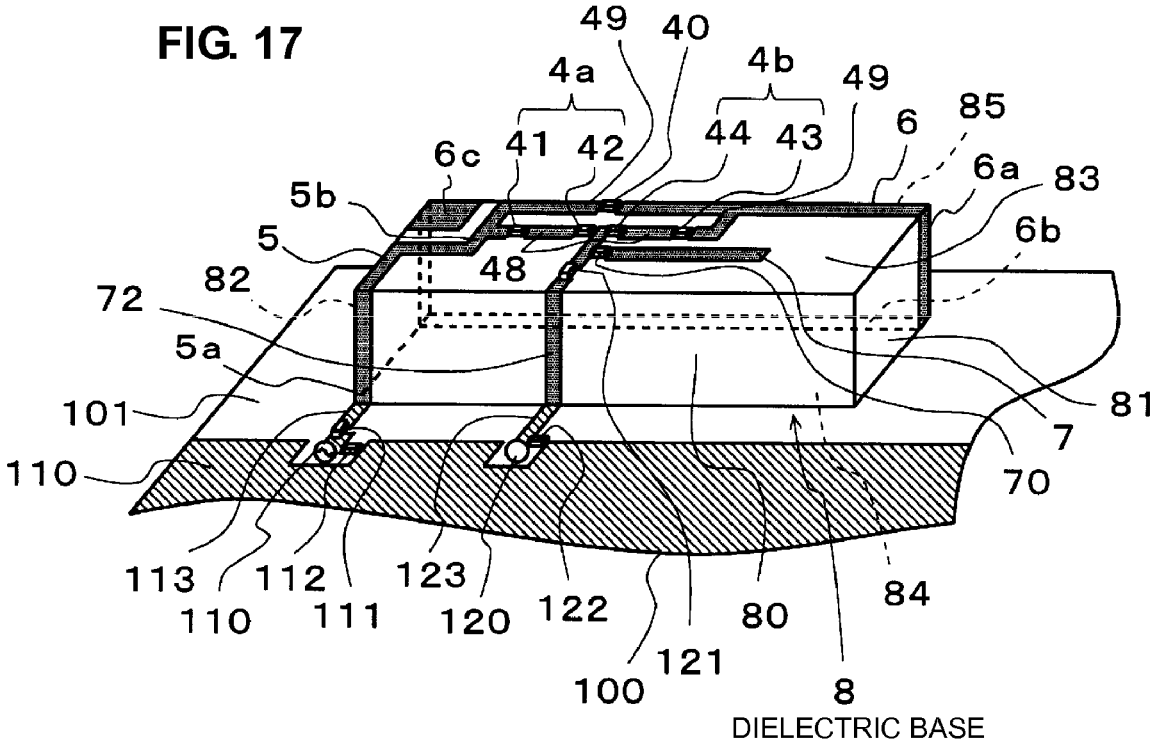
FIG. 17 is a perspective view showing an antenna according to a seventh preferred embodiment of the present invention.

FIG. 17 is a perspective view showing an antenna according to the seventh preferred embodiment of the present invention.

In this preferred embodiment, antenna elements, such as the feeding electrode 5, the frequency-changing circuit 4, the radiating electrode 6, and the additional radiating electrode 7, are preferably disposed on a predetermined dielectric base.

This preferred embodiment will be described in the context of an example where the antenna shown in part (a) of FIG. 15 is disposed on a surface of a dielectric base 8, as shown in FIG. 17.

More specifically, the dielectric base 8 preferably has a substantially rectangular shape having a front surface 80, side surfaces 81 and 82, a top surface 83, a bottom surface 84, and a rear surface 85, and is mounted on the non-ground region 101 of the circuit board 100.

The feeding electrode 5 is arranged so as to have a pattern extending from the front surface 80 to the top surface 83 on the left side of the dielectric base 8. On the non-ground region 101, a pattern 113 is provided, and the pattern 113 is connected to the transceiver 110 via the inductor 112. One end 5*a* of the feeding electrode 5 is connected to the pattern 113, and the other end 5*b* is connected to the frequency-changing circuit 4. In the frequency-changing circuit 4, the inductor 41 and the variable-capacitance diode 42 of the first reactance circuit 4*a* and the inductor 43 and the variable-capacitance diode 44 of the second reactance circuit 4*b* are preferably implemented individually by chip components, and the chip components are connected via a pattern 48 disposed on the top surface 83.

The inductor 40 is arranged on the top surface 83 across the first reactance circuit 4*a* and the second reactance circuit 4*b*. More specifically, a pattern 49 that is parallel to the pattern 48 is provided, and the inductor 40 is disposed in the middle of the pattern 49.

The radiating electrode 6 has an electrode section 6*a* extending rightward from a connecting portion of the patterns 48 and 49 along the upper end of the top surface 83 and then extending downward on the side surface 81. An electrode section 6*b*, which is continuous with the electrode section 6*a*, extends leftward on the bottom surface 84 and then extends upward on the side surface 82. A top end of the electrode section 6*b* is joined with an electrode section 6*c* disposed at a corner on the top surface 83. That is, the radiating electrode 6 is constituted by the electrode sections 6*a* to 6*c*, and defines a loop as a whole.

Furthermore, a pattern 72 extends from a connecting portion of the variable-capacitance diodes 42 and 44 of the frequency-changing circuit 4. The pattern 72 extends on the top surface 83 and the front surface 80 and is connected to a pattern 123 disposed on the non-ground region 101 and extending to the reception-frequency controller 120. The high-frequency-cut capacitor 121 is disposed in the middle of the pattern 72.

The additional radiating electrode 7 is arranged so as to have a pattern extending substantially perpendicularly to the pattern 72 described above, and is connected to the pattern 72 via the resonant-frequency adjusting inductor 70.

With the configuration described above, it is possible to adjust the reactances of the first and second antenna sections 2 and 3 by changing the dielectric constant of the dielectric base 8.

The configuration, operation, and advantages are otherwise the same as those of the first to sixth preferred embodiments described above, so that description thereof will be omitted.

Although substantially all the antenna elements, such as the feeding electrode 5, are disposed on the dielectric base 8 in this preferred embodiment, it is possible to provide only some of the antenna elements on the dielectric base 8. Also, although the antenna shown in part (a) of FIG. 15 is preferably provided on a surface of the dielectric base 8 in this preferred embodiment, without limitation thereto, obviously, any of the antennas according to all the preferred embodiments described above may be disposed on a surface of the dielectric base 8.

Eighth Preferred Embodiment

Next, an eighth preferred embodiment of the present invention will be described.

Figure 18:
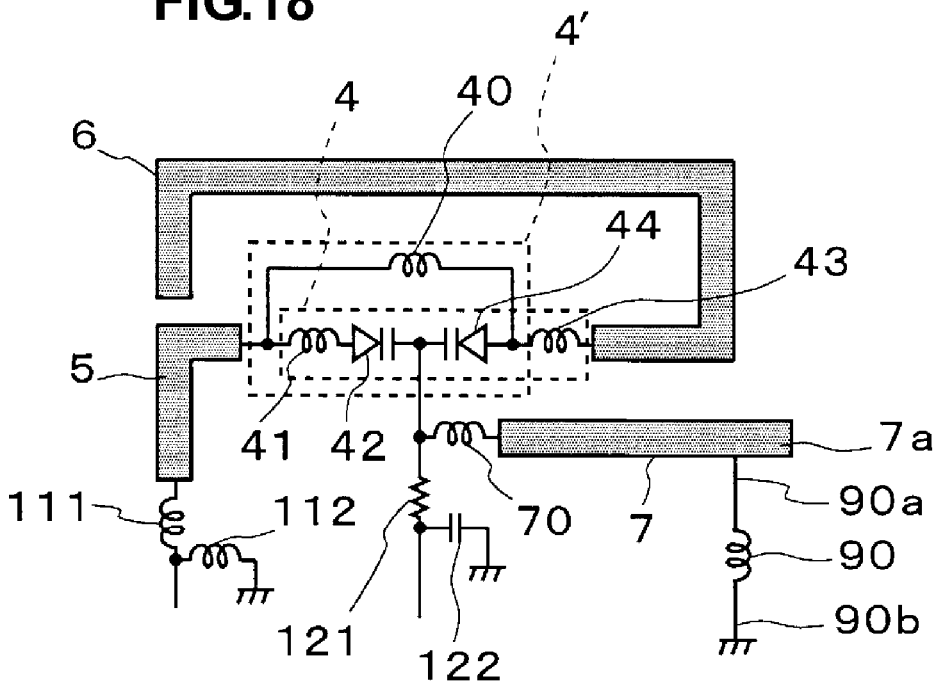
FIG. 18 is a schematic plan view showing an antenna according to an eighth preferred embodiment of the present invention.
Figure 19:
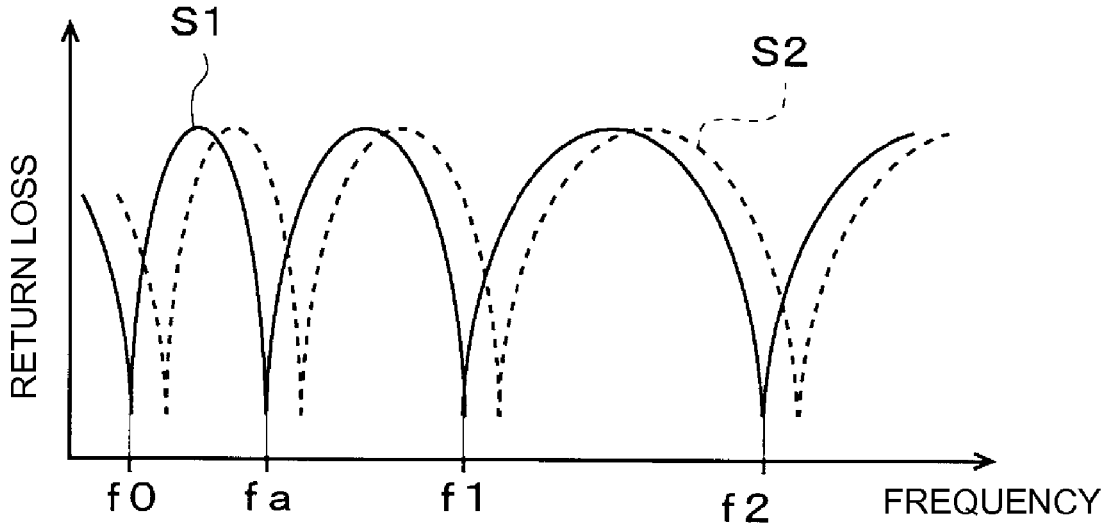
FIG. 19 is a diagram showing a curve representing return loss that is caused due to the characteristics of an added inductor.

FIG. 18 is a schematic plan view showing an antenna according to the eighth preferred embodiment of the present invention, and FIG. 19 is a diagram showing a curve representing return loss that is caused due to the characteristics of an added inductor.

This preferred embodiment differs from the preferred embodiments described above in that a discrete inductor 90 is connected in the middle of the additional radiating electrode 7 of the second antenna section 3, as shown in FIG. 18.

More specifically, one end 90*a* of the inductor 90 is connected to the distal-end side of the additional radiating electrode 7, and the other end 90*b* is connected to the ground region 102 (see FIG. 1).

With the configuration described above, as indicated by a return-loss curve S1 in FIG. 19, assuming that the resonant frequency associated with the inductor 111, the feeding electrode 5, and a frequency-changing-circuit portion 4' is f0, the resonant frequency associated with the inductor 111, the feeding electrode 5, the frequency-changing circuit 4, and the radiating electrode 6 is f1, and the resonant frequency associated with the inductor 111, the feeding electrode 5, the frequency-changing circuit 4, the resonant-frequency adjusting inductor 70, and the additional radiating electrode 7 is f2, a resonant frequency fa associated with the inductor 111, the feeding electrode 5, the frequency-changing circuit 4, the resonant-frequency adjusting inductor 70, the additional radiating electrode 7, and the inductor 90 is newly generated.

As the inductor 90, an inductor that exhibits a high impedance when it is connected to the additional radiating electrode 7 and the ground region 102 is preferably chosen, so that degradation of antenna gain is prevented. By using the inductor 90 with a high impedance, without significantly affecting the resonant frequency f2 associated with the inductor 111, the feeding electrode 5, the frequency-changing circuit 4, the resonant-frequency adjusting inductor 70, and the additional radiating electrode 7, the new resonant frequency fa, which is lower than the frequency of the additional radiating electrode 7 at the source of branching, is generated. When the low resonant frequency is obtained using only an electrode, a considerably long electrode must be used, so that the cubic size of the antenna increases. However, by generating the new resonant frequency fa using the inductor 90 as in this preferred embodiment instead of using an electrode, the cubic size of the antenna can be reduced.

Furthermore, since the frequency-changing circuit 4 including the variable-capacitance diodes 42 and 44 is disposed between the feeding electrode 5 and the radiating electrode 6 and between the feeding electrode 5 and the additional radiating electrode 7, by applying the control voltage Vc to the frequency-changing circuit 4, the resonant frequencies f0, fa, f1, and f2 can be changed as a whole, as indicated by a return-loss curve S2 represented by a broken line in FIG. 19.

By setting the resonant frequencies f0, fa, f1, and f2 appropriately, FM electromagnetic waves, electromagnetic waves in the VHF band, and electromagnetic waves in the UHF band can be received.

The configuration, operation, and advantages are otherwise the same as those of the preferred embodiments described above, so that description thereof will be omitted.

Although the inductor 90 is preferably connected in the middle of the additional radiating electrode 7 of the second antenna section in the present preferred embodiment, the inductor 90 may be provided on the side of the open distal end 7*a* of the additional radiating electrode 7. However, antenna gain could be degraded when the inductor 90 is disposed too close to the side of the open distal end 7*a*, so that it is preferable that the inductor 90 be connected to the additional radiating electrode 7 with consideration of this point.

Furthermore, although the inductor 90 is connected only to the additional radiating electrode 7 of the second antenna section in this preferred embodiment, it is possible to connect the inductor 90 only to the middle of the radiating electrode 6 of the first antenna section 2 instead of connecting to the additional radiating electrode 7.

Furthermore, although one inductor 90 is connected as the inductor 90, without limitation thereto, a plurality of inductors 90 may be connected in parallel.

Ninth Preferred Embodiment

Next, a ninth preferred embodiment of the present invention will be described.

Figure 20:
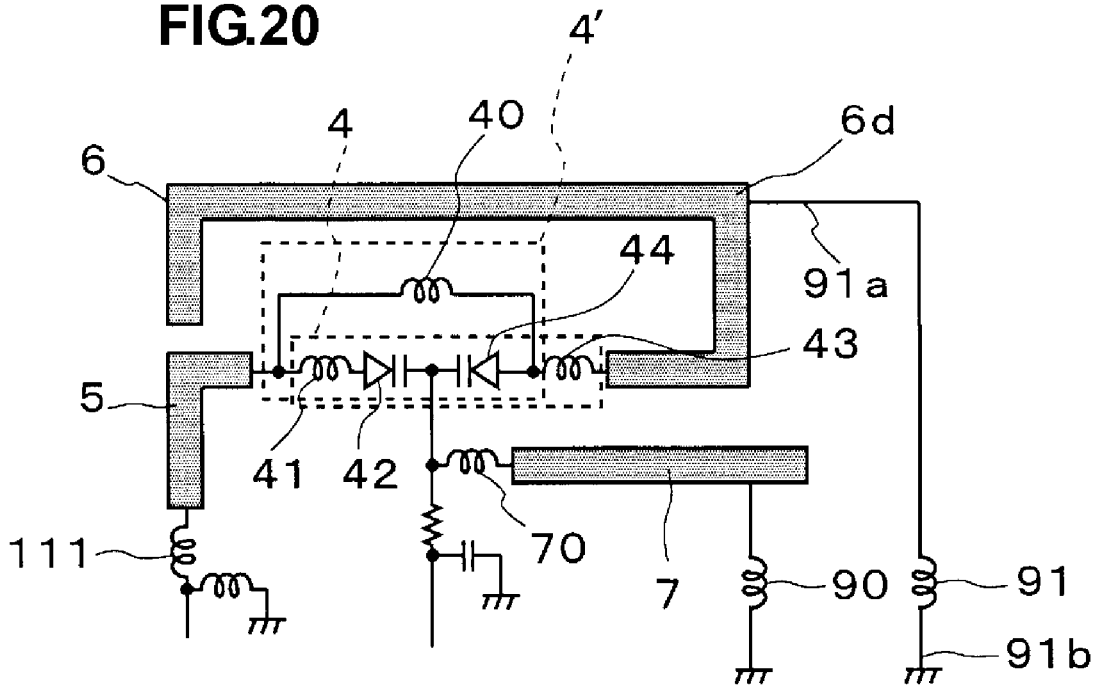
FIG. 20 is a schematic plan view showing an antenna according to a ninth preferred embodiment of the present invention.
Figure 21:
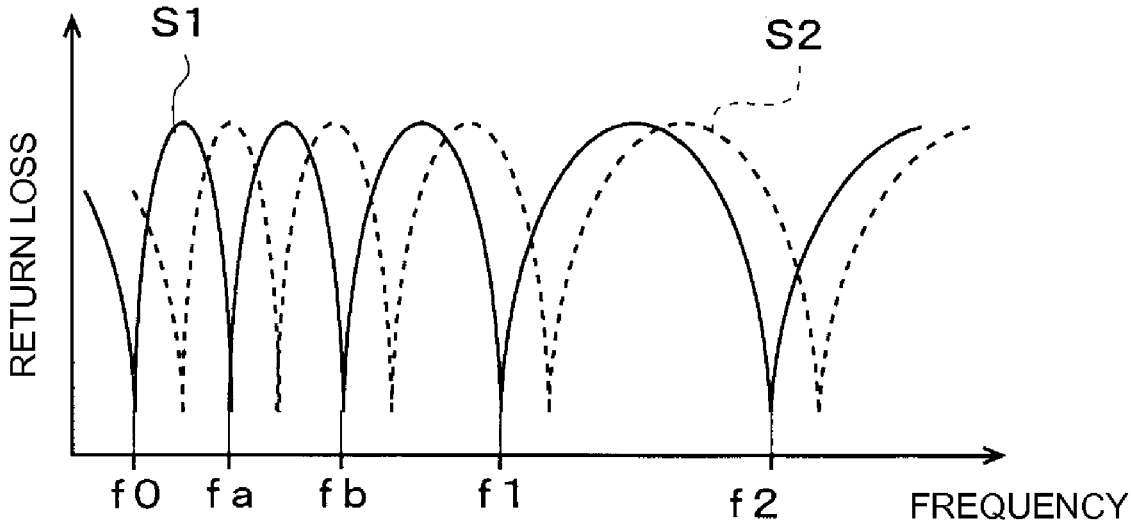
FIG. 21 is a diagram showing a curve representing return loss that is caused due to the characteristics of two added inductors.

FIG. 20 is a schematic plan view showing an antenna according to the ninth preferred embodiment of the present invention, and FIG. 21 is a diagram showing a curve representing return loss that is caused due to the characteristics of two added inductors.

This embodiment differs from the eighth preferred embodiment described above in that a discrete inductor 91 is connected also in the middle of the radiating electrode 6 of the first antenna section 2, as shown in FIG. 20.

More specifically, one end 91*a* of the inductor 91 is connected to a bent portion 6*d* of the radiating electrode 6, and the other end 91*b* is connected to the ground region 102.

Thus, as indicated by a return-loss curve S1 in FIG. 21, in addition to the resonant frequency f0 associated with the inductor 111, the feeding electrode 5, and the frequency-changing-circuit portion 4', the resonant frequency fa associated with the inductor 111, the feeding electrode 5, the frequency-changing circuit 4, the resonant-frequency adjusting inductor 70, the additional radiating electrode 7, and the inductor 90, the resonant frequency f1 associated with the inductor 111, the feeding electrode 5, the frequency-changing circuit 4, and the radiating electrode 6, and the resonant frequency f2 associated with the inductor 111, the feeding electrode 5, the frequency-changing circuit 4, the resonant-frequency adjusting inductor 70, and the additional radiating electrode 7, a new resonant frequency fb, which is lower than the frequency of the radiating electrode 6 at the source of branching, is newly generated by the inductor 111, the feeding electrode 5, the frequency-changing circuit 4, the radiating electrode 6, and the inductor 91.

The inductor 91 preferably is also an inductor with a high impedance, similarly to the inductor 90, and the resonant frequency fb is a low frequency located between the resonant frequencies fa and f1.

By applying the control voltage Vc to the frequency-changing circuit 4, the resonant frequencies f0, fa, fb, f1, and f2 can be changed as a whole, as indicated by a return-loss curve S2 represented by a broken line in FIG. 21.

The configuration, operation, and advantages are otherwise the same as those of the eighth preferred embodiment described earlier, so that description thereof will be omitted.

Tenth Preferred Embodiment

Next, a tenth preferred embodiment of the present invention will be described.

Figure 22:
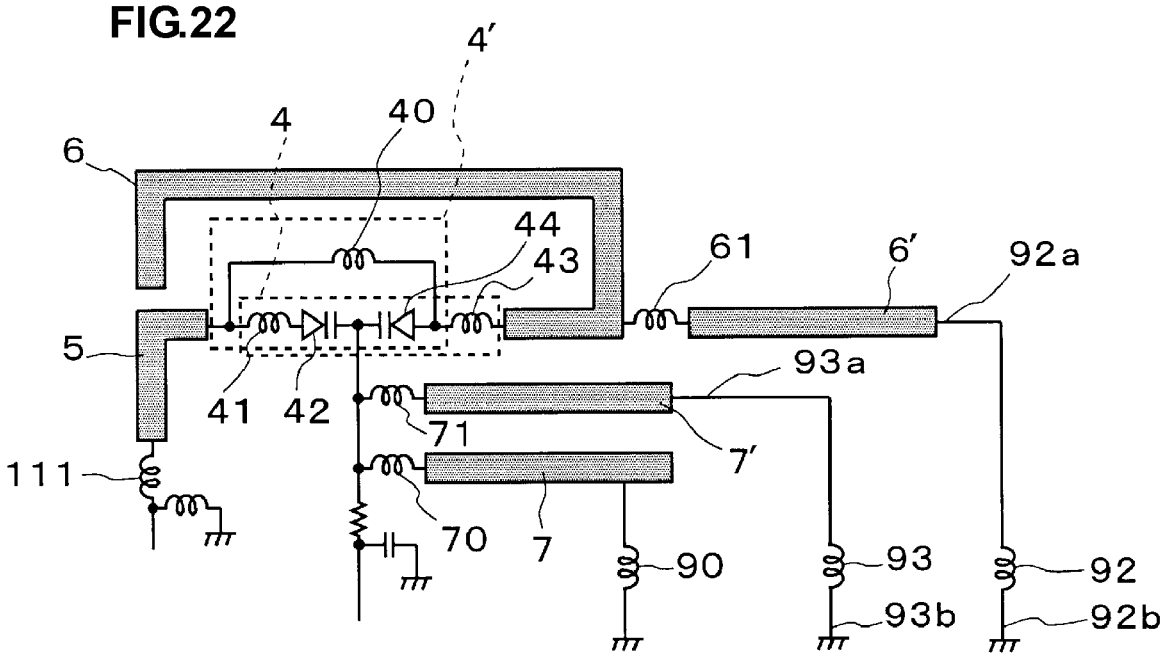
FIG. 22 is a schematic plan view showing an antenna according to a tenth preferred embodiment of the present invention.
Figure 23:
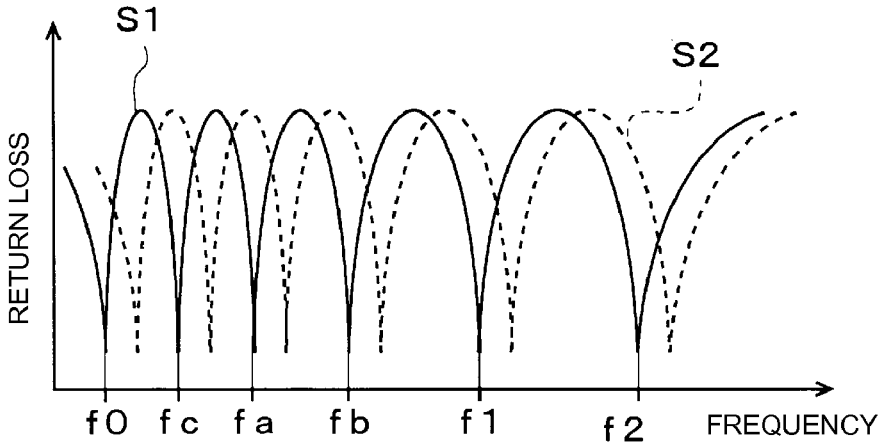
FIG. 23 is a diagram showing a curve representing return loss that is caused due to the characteristics of three added inductors.

FIG. 22 is a schematic plan view showing an antenna according to the tenth preferred embodiment of the present invention, and FIG. 23 is a diagram showing a curve representing return loss that is caused due to the characteristics of three added inductors.

This preferred embodiment differs from the eighth and ninth preferred embodiments described above in that, in an antenna in which additional radiating electrodes 6' and 7' separate from the additional radiating electrode 7 of the second antenna section 3 are provided, discrete inductors 92 and 93 are also connected to the additional radiating electrodes 6' and 7', respectively, as shown in FIG. 22.

More specifically, one end 92*a* of the inductor 92 is connected to a bent portion 6*e* of the radiating electrode 6, and the other end 92*b* is connected to the ground region 102. Also, one end 93*a* of the inductor 93 is connected to an open distal end of the additional radiating electrode 7', and the other end 93*b* is connected to the ground region 102.

Thus, as indicated by a return-loss curve S1 in FIG. 23, in addition to the resonant frequencies f0, fa, f1, and f2, a new resonant frequency fb, which is lower than the frequency of the additional radiating electrode 6' at the source of branching, is newly generated by the inductor 111, the feeding electrode 5, the frequency-changing circuit 4, the radiating electrode 6, the resonant-frequency adjusting inductor 61, the additional radiating electrode 6', and the inductor 92, and a new resonant frequency fc, which is lower than the frequency of the additional radiating electrode 7' at the source of branching, is newly generated by the inductor 111, the feeding electrode 5, the frequency-changing circuit 4, the resonant-frequency adjusting inductor 71, the additional radiating electrode 7' and the inductor 93.

These inductors 92 and 93 preferably are inductors with high impedances, similarly to the inductors 90 and 91. The resonant frequency fb is a low frequency located between the resonant frequencies fa and f1, and the resonant frequency fc is a low frequency located between the resonant frequencies f0 and fa.

By applying the control voltage Vc to the frequency-changing circuit 4, the resonant frequencies f0, fc, fa, fb, f1, and f2 can be changed as a whole, as indicated by a return-loss curve S2 represented by a broken line in FIG. 23.

The configuration, operation, and advantages are otherwise the same as those of the eighth and ninth preferred embodiments described earlier, so that description thereof will be omitted.

Eleventh Preferred Embodiment

Next, an eleventh preferred embodiment of the present invention will be described.

Figure 24:
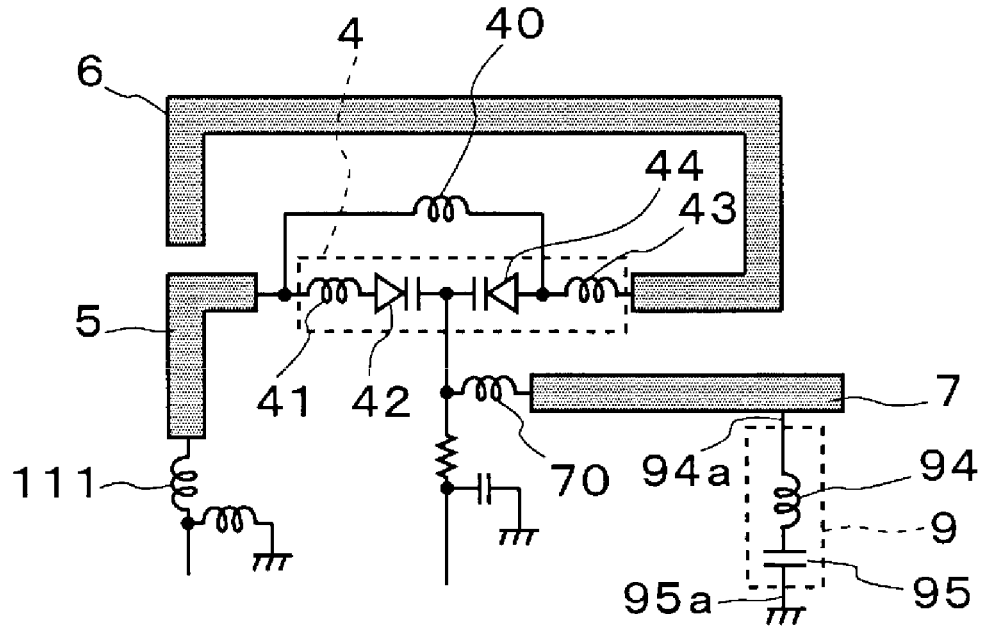
FIG. 24 is a schematic plan view showing an antenna according to an eleventh preferred embodiment of the present invention.
Figure 25:
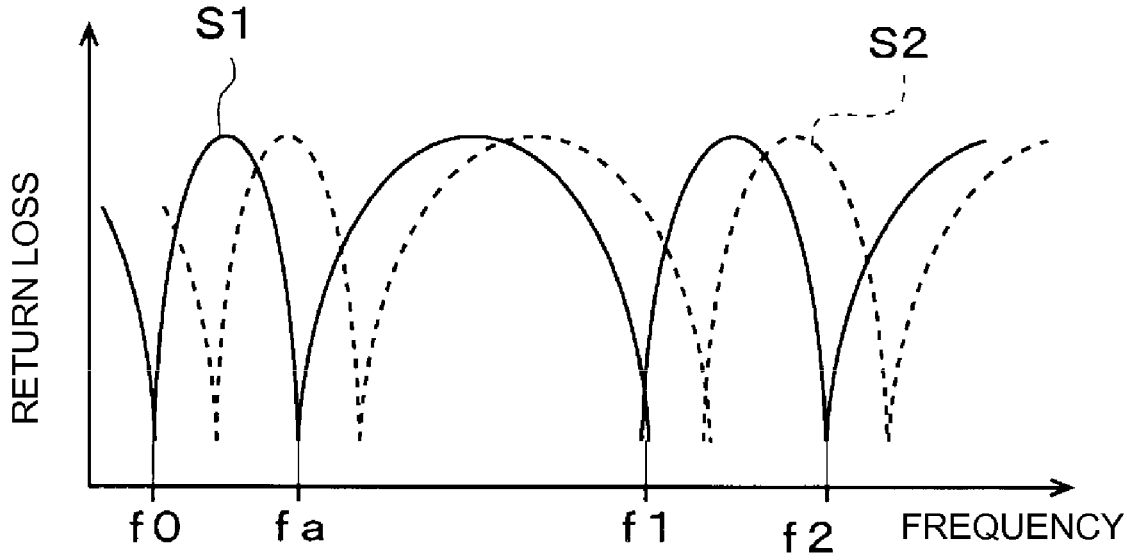
FIG. 25 is a diagram showing a curve representing return loss that is caused due to the characteristics of an added series resonance circuit.
Figure 26:
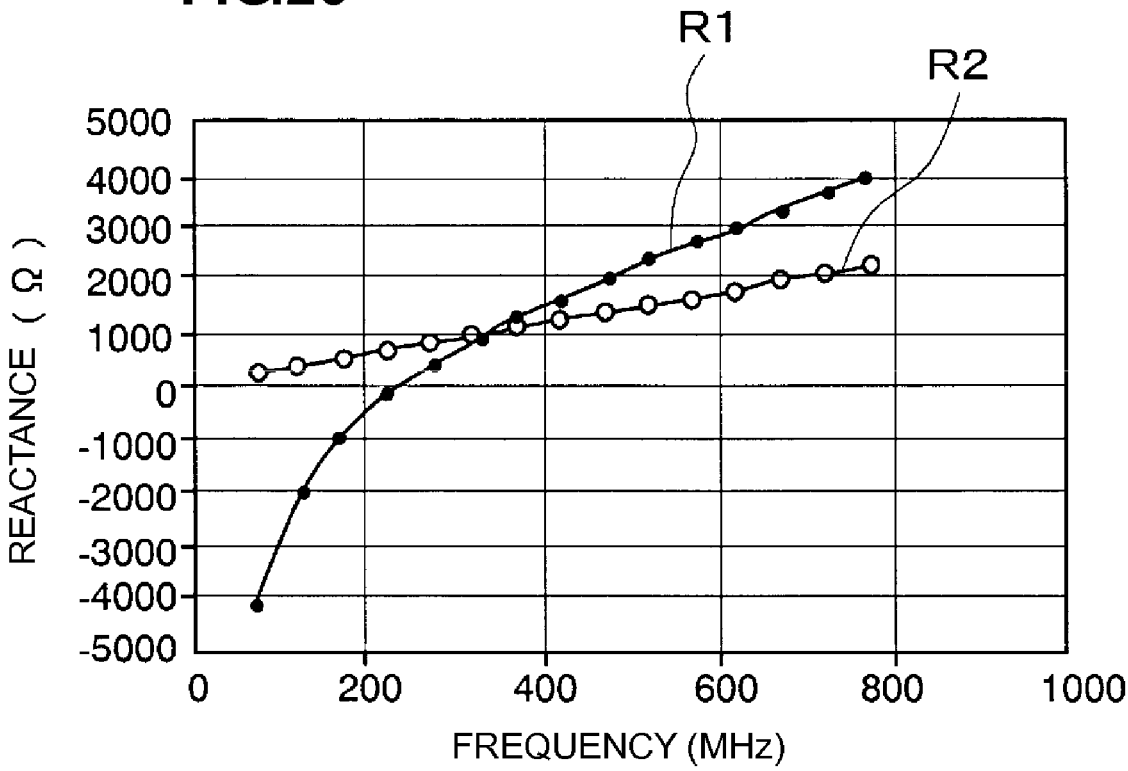
FIG. 26 is a diagram showing comparison between the reactance of a discrete inductor and the reactance of a series resonance circuit.

FIG. 24 is a schematic plan view showing an antenna according to the eleventh preferred embodiment of the present invention. FIG. 25 is a diagram showing a curve representing return loss that is caused due to the characteristics of an added series resonance circuit. FIG. 26 is a diagram showing comparison between the reactance of a discrete inductor and the reactance of the series resonance circuit.

This preferred embodiment differs from the eighth to tenth preferred embodiments described above in that a series resonance circuit 9 as a reactance circuit is connected to the additional radiating electrode 7 of the second antenna section 3, as shown in FIG. 24.

More specifically, the series resonance circuit 9 preferably includes an inductor 94 and a capacitor 95 connected in series. One end 94*a* of the inductor 94 is connected to the distal-end side of the additional radiating electrode 7, and one end 95*a* of the capacitor 95 is connected to the ground region 102.

Thus, as indicated by a return-loss curve S1 in FIG. 25, in addition to the resonant frequencies f0, f1, and f2, a new frequency fa associated with the inductor 111, the feeding electrode 5, the frequency-changing circuit 4, the resonant-frequency adjusting inductor 70, the additional radiating electrode 7, and the series resonance circuit 9 is newly generated.

By applying the control voltage Vc to the frequency-changing circuit 4, the resonant frequencies f0, fa, f1, and f2 can be changed as a whole, as indicated by a return-loss curve S2 represented by a broken line in FIG. 25.

In a series resonance circuit such as the series resonance circuit 9, as indicated by a reactance curve R1 in FIG. 26, the slope of change of reactance in relation to frequency is large compared with cases of discrete inductors 90 to 93 indicated by a reactance curve R2. Thus, when the reactance of a discrete inductor and the reactance of a series resonance circuit needed for an additional resonance are equal, the reactance at the resonant frequency of an electrode at the source of branching (the additional radiating electrode 7 in this preferred embodiment) is larger in the case of the series resonance circuit compared with the case of the discrete inductor. That is, in this preferred embodiment, by connecting the series resonance circuit 9 to the additional radiating electrode 7 instead of the inductor 90, a new resonant frequency fa is obtained without significantly affecting the resonant frequency f2 associated with the inductor 111, the feeding electrode 5, the frequency-changing circuit 4, the resonant-frequency adjusting inductor 70, and the additional radiating electrode 7. Thus, an antenna having favorable operation characteristics can be provided.

The configuration, operation, and advantages are otherwise the same as the eighth to tenth preferred embodiments described earlier, so that description thereof will be omitted.

Twelfth Preferred Embodiment

Next, a twelfth preferred embodiment of the present invention will be described.

Figure 27:
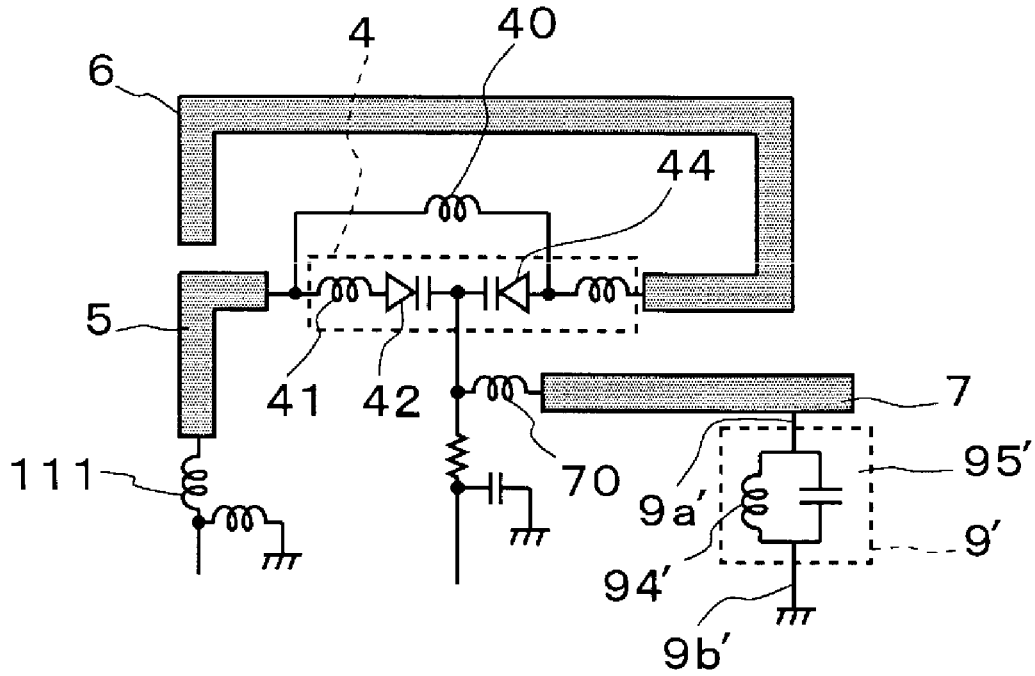
FIG. 27 is a schematic plan view showing an antenna according to a twelfth preferred embodiment of the present invention.
Figure 28:
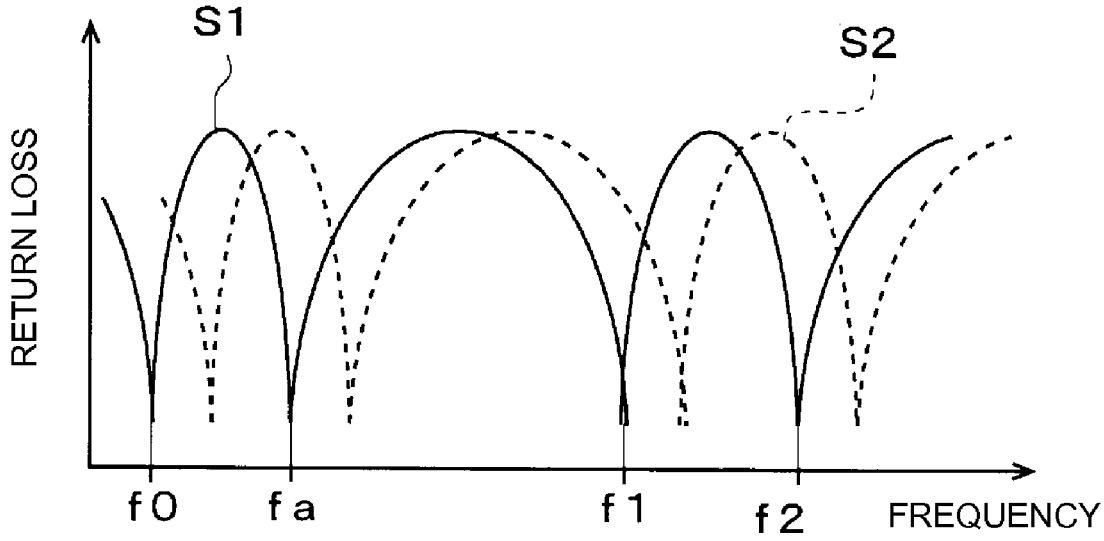
FIG. 28 is a diagram showing a curve representing return loss that is caused due to the characteristics of an added series resonance circuit.

FIG. 27 is a schematic plan view showing an antenna according to the twelfth preferred embodiment of the present invention, and FIG. 28 is a diagram showing a curve representing return loss that is caused due to the characteristics of an added series resonance circuit.

This embodiment differs from the eleventh preferred embodiment described above in that a parallel resonance circuit 9' as a reactance circuit is connected to the additional radiating electrode 7 of the second antenna section 3, as shown in FIG. 27.

More specifically, the parallel resonance circuit 9' preferably includes an inductor 94' and a capacitor 95' connected in parallel. One end 9*a*' of the parallel resonance circuit 9' is connected to the distal end of the additional radiating electrode 7, and one end 9*b*' of the other ends is connected to the ground region 102.

Thus, as indicated by a return-loss curve S1 in FIG. 28, in addition to the resonant frequencies f0, f1, and f2, a resonant frequency fa associated with the inductor 111, the feeding electrode 5, the frequency-changing circuit 4, the resonant-frequency adjusting inductor 70, the additional radiating electrode 7, and the parallel resonance circuit 9' is newly generated.

By applying the control voltage Vc to the frequency-changing circuit 4, the resonant frequencies f0, fa, f1, and f2 can be changed as a whole, as indicated by a return-loss curve S2 represented by a broken line in FIG. 28.

In order to obtain a large reactance using the series resonance circuit 9 in the eleventh preferred embodiment described earlier, the inductor 94 that is used must have a large constant (nH). Usually, a chip component is used as the inductor 94. When a chip component having a large constant is used, the self-resonant frequency decreases, so that the inductivity is degraded. In contrast, by using the parallel resonance circuit 9' as in this preferred embodiment, it is possible to obtain a large reactance using the inductor 94' having a small constant. Thus, by using the parallel resonance circuit 9', the problem of a chip component regarding the self-resonant frequency can be solved.

The configuration, operation, and advantages are otherwise the same as the eleventh preferred embodiment described earlier, so that description thereof will be omitted.

Thirteenth Preferred Embodiment

Next, a thirteenth preferred embodiment of the present invention will be described.

Figure 29:
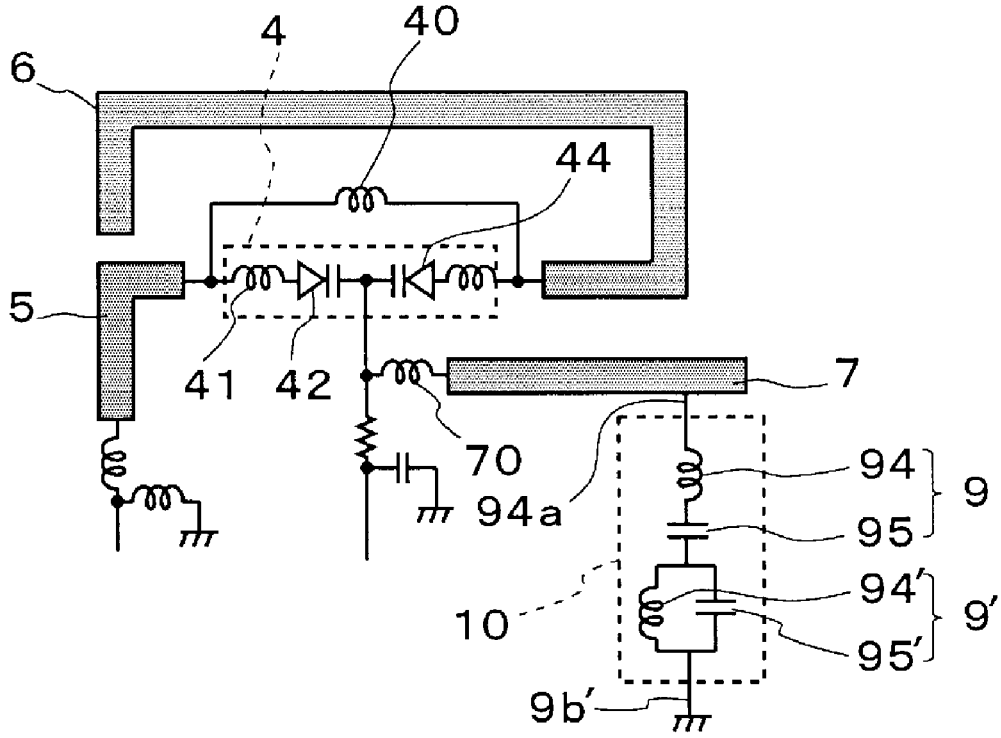
FIG. 29 is a schematic plan view showing an antenna according to a thirteenth preferred embodiment of the present invention.
Figure 30:
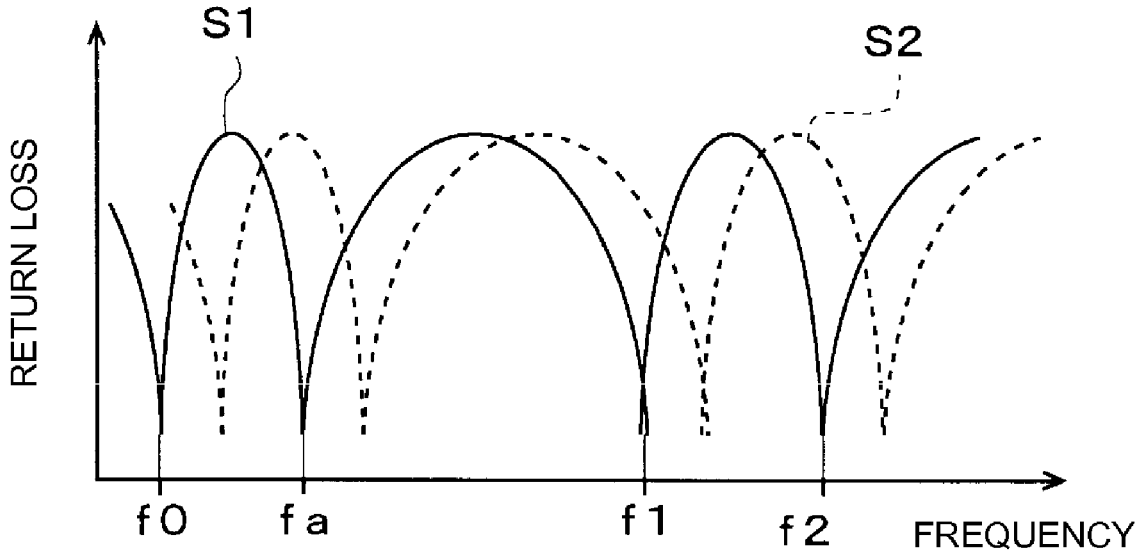
FIG. 30 is a diagram showing a curve representing return loss that is caused due to the characteristics of an added series resonance circuit.
Figure 31:
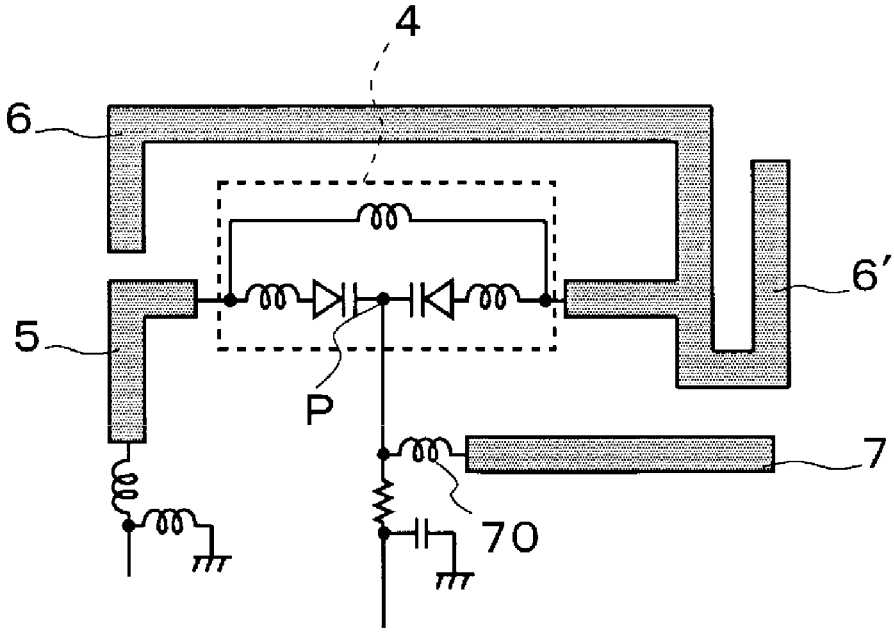
FIG. 31 is a schematic plan view showing a modification in which a radiating electrode is directly disposed on an additional radiating electrode.

FIG. 29 is a schematic plan view showing an antenna according to the thirteenth preferred embodiment of the present invention, and FIG. 30 is a diagram showing a curve representing return loss that is caused due to the characteristics of an added series resonance circuit.

This preferred embodiment differs from the eleventh and twelfth preferred embodiments described above in that a composite circuit 10 including the series resonance circuit 9 and the parallel resonance circuit 9' is connected as a reactance circuit to the additional radiating electrode 7 of the second antenna section 3, as shown in FIG. 29.

More specifically, the composite circuit 10 preferably includes the series resonance circuit 9 and the parallel resonance circuit 9' connected in series. One end 94*a* of the inductor 94 of the series resonance circuit 9 is connected to the distal-end side of the additional radiating electrode 7, and one end 9*b*' of the parallel resonance circuit 9' is connected to the ground region 102.

Thus, as indicated by a return-loss curve S1 in FIG. 30, in addition to the resonant frequencies f0, f1, and f2, a resonant frequency fa associated with the inductor 111, the feeding electrode 5, the frequency-changing circuit 4, the resonant-frequency adjusting inductor 70, the additional radiating electrode 7, and the composite circuit 10 is newly generated.

By applying the control voltage Vc to the frequency-changing circuit 4, the resonant frequencies f0, fa, f1, and f2 can be changed as a whole, as indicated by a return-loss curve S2 represented by a broken line in FIG. 30.

With the configuration described above, it is possible to achieve both the advantage of the series resonance circuit 9 that the new resonant frequency fa can be obtained without significantly affecting the resonant frequency f2 associated with the additional radiating electrode 7 and the advantage of the parallel resonance circuit 9' that the problem of an inductor chip component regarding the self-resonant frequency can be solved.

The configuration, operation, and advantages are otherwise the same as those of the eleventh and twelfth preferred embodiments described earlier, so that descriptions thereof will be omitted.

The present invention is not limited to the preferred embodiments described above, and various alternatives or modifications are possible without departing from the spirit of the present invention.

For example, although the above-described preferred embodiments have been described in the context of examples where an additional radiating electrode is connected to the node P of the frequency-changing circuit 4 or the middle of the radiating electrode 6 via a resonant-frequency adjusting inductor, an additional radiating electrode 6' that is separate from the additional radiating electrode 7 constituting the second antenna section 3 may be disposed directly in the middle of the radiating electrode 6.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An antenna comprising:

a first antenna section in which a radiating electrode having an open distal end is connected to a feeding electrode via a frequency-changing circuit; and a second antenna section including an additional radiating electrode and the feeding electrode, the additional radiating electrode having an open distal end and being connected to a middle portion of the frequency-changing circuit; wherein the frequency-changing circuit includes a first reactance circuit and a second reactance circuit connected to each other, the first reactance circuit being connected to the feeding electrode and having a reactance that is variable according to a direct-current control voltage, and the second reactance circuit being connected to the radiating electrode of the first antenna section; and the additional radiating electrode of the second antenna section branches from a node defined between the first and second reactance circuits.

2. The antenna according to claim 1, wherein the second reactance circuit has a reactance that is variable according to the control voltage.

3. The antenna according to claim 1, wherein the second reactance circuit has a reactance that is fixed.

4. The antenna according to claim 2, wherein the first reactance circuit is a series circuit including a variable capacitor or a parallel circuit including a variable capacitor; and the second reactance circuit is a series circuit including a variable capacitor or a parallel circuit including a variable capacitor; and terminals of the variable capacitors of the first and second reactance circuits, the terminals having the same polarity, are connected to each other to define a node between the first and second reactance circuits, and the control voltage is applied to the node to control capacitances of the variable capacitors.

5. The antenna according to claim 3, wherein the first reactance circuit is a series circuit including a variable capacitor or a parallel circuit including a variable capacitor; the second reactance circuit is a series circuit including a fixed capacitor or a parallel circuit including a fixed capacitor; and the variable capacitor of the first reactance circuit is connected to the second reactance circuit to define a node between the first and second reactance circuits, and the control voltage is applied to the node to control a capacitance of the variable capacitor.

6. The antenna according to claim 1, wherein an inductor is connected in parallel to the first reactance circuit and the second reactance circuit across the first and second reactance circuits.

7. The antenna according to claim 1, wherein the additional radiating electrode branches from the node via an inductor arranged to control a resonant frequency.

8. The antenna according to claim 1, wherein one or more additional radiating electrodes that are separate from the additional radiating electrode are arranged to branch from the node.

9. The antenna according to claim 8, wherein each of the one or more separate additional radiating electrodes branches from the node via another reactance circuit having the same configuration as the first reactance circuit, and another control voltage for controlling a capacitance of a variable capacitor of the another reactance circuit is applied to the another reactance circuit.

10. The antenna according to claim 1, wherein an additional radiating electrode that is separate from the additional radiating electrode is connected to a middle portion of the radiating electrode.

11. The antenna according to claim 10, wherein the separate additional radiating electrode is connected to the radiating electrode via an inductor.

12. The antenna according to claim 1, wherein the first antenna section has a shape of a loop in which the feeding electrode and the open distal end of the radiating electrode are opposed via a gap.

13. The antenna according to claim 1, wherein one or more of the feeding electrode, the frequency-changing circuit, the radiating electrode, and the additional radiating electrode are disposed on a dielectric base.

14. The antenna according to claim 1, wherein in one or more of the radiating electrode of the first antenna section, the additional radiating electrode of the second antenna section, and the one or more separate additional radiating electrodes, a middle portion or an open distal end of the electrode is connected to a ground via an inductor or a reactance circuit.

15. The antenna according to claim 14, wherein the reactance circuit is a series resonance circuit or a parallel resonance circuit, or a composite circuit including a series resonance circuit and a parallel resonance circuit.

16. The antenna according to claim 14, wherein the antenna is configured to allow reception of FM electromagnetic waves, electromagnetic waves in the VHF band, and electromagnetic waves in the UHF band.

17. A wireless communication device comprising the antenna according to claim 1.

* * * * *